US011717939B2

(12) United States Patent
Blaine

(10) Patent No.: US 11,717,939 B2
(45) **Date of Patent: *Aug. 8, 2023**

(54) DUAL CUTTER HEAD PORTIONING AND TRIMMING

(71) Applicant: John Bean Technologies Corporation, Chicago, IL (US)

(72) Inventor: George R. Blaine, Lake Stevens, WA (US)

(73) Assignee: John Bean Technologies Corporation, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/661,201

(22) Filed: Apr. 28, 2022

(65) Prior Publication Data

US 2022/0250206 A1 Aug. 11, 2022

Related U.S. Application Data

(63) Continuation of application No. 17/305,800, filed on Jul. 14, 2021, now Pat. No. 11,318,580.

(60) Provisional application No. 63/052,000, filed on Jul. 15, 2020.

(51) Int. Cl.
*B24C 1/00* (2006.01)
*B24C 1/04* (2006.01)

(52) U.S. Cl.
CPC ..... *B24C 1/045* (2013.01)

(58) Field of Classification Search
CPC . A22B 5/0017; A22B 5/0041; A22C 17/0006; A22C 17/004; A22C 17/0073; A22C 17/0086; B24C 1/045
USPC ..... 452/141
See application file for complete search history.

(56) References Cited

U.S. PATENT DOCUMENTS

| | | | | |
|---|---|---|---|---|
| 3,982,299 | A | 9/1976 | Kompan | |
| 6,692,345 | B1 * | 2/2004 | Kruger | A22B 5/0029 452/183 |
| 2002/0067797 | A1 | 6/2002 | Safai et al. | |
| 2012/0282845 | A1 | 11/2012 | Whang et al. | |
| 2017/0108855 | A1 * | 4/2017 | Hocker | G01N 33/12 |

(Continued)

FOREIGN PATENT DOCUMENTS

| | | | |
|---|---|---|---|
| EP | 0 307 174 | A1 | 3/1989 |
| WO | 2017/011400 | A1 | 1/2017 |

OTHER PUBLICATIONS

International Search Report and Written Opinion dated Dec. 23, 2021, issued in corresponding International Application No. PCT/US2021/041641, filed Jul. 14, 2021, 12 pages.

*Primary Examiner* — Richard T Price, Jr.
(74) *Attorney, Agent, or Firm* — Christensen O'Connor Johnson Kindness PLLC

(57) ABSTRACT

A conveyance system 14 carries food products 12 past the scanning system 16 for scanning the food products and generating data pertaining to various parameters of the food products. Thereafter, the food products 12 are transported past a processing station 18 for cutting, trimming, portioning, etc. using a cutting apparatus 20 in the form of a robotic actuator 22 onto which is mounted a dual headed cutter assembly 24 capable of independently and simultaneously cutting/trimming/portioning two separate food products 12, for example, located in side-by-side lanes on the conveyance system or capable of independently and simultaneously cutting/trimming the opposite sides of the same food product.

23 Claims, 15 Drawing Sheets

(56) References Cited

U.S. PATENT DOCUMENTS

| | | | | |
|---|---|---|---|---|
| 2017/0217044 | A1* | 8/2017 | Blaine | B26D 5/02 |
| 2020/0068909 | A1* | 3/2020 | Blaine | G05B 19/4166 |
| 2020/0288729 | A1* | 9/2020 | Blaine | G05B 17/02 |
| 2020/0375203 | A1* | 12/2020 | Pfanstiel | G01N 23/083 |
| 2021/0227840 | A1* | 7/2021 | Blaine | B26D 5/007 |

* cited by examiner

DUAL CUTTER HEAD PORTIONING AND TRIMMING

CROSS REFERENCES TO RELATED APPLICATIONS

This application is a continuation of U.S. patent application Ser. No. 17/305,800, filed Jul. 14, 2021 (now U.S. Pat. No. 11,318,580), which claims priority to U.S. Provisional Application No. 63/052,000, filed Jul. 15, 2020, the entire contents of both of which applications are incorporated herein by reference.

BACKGROUND

Workpieces, including food products, are commonly portioned or otherwise cut into smaller pieces by processors in accordance with customer needs. Also, excess fat, bone and other foreign or undesired materials are routinely trimmed from the food products. It is usually highly desirable to portion and/or trim the food products into uniform sizes, for example, for steaks to be served at restaurants or chicken fillets used in frozen dinners or in chicken burgers.

Much of the portioning/trimming of food products is now carried out with the use of high-speed portioning machines. These machines use various scanning techniques to ascertain the size and shape of the food product as it is being advanced on a moving conveyor. This information is analyzed with the aid of a computer to determine how to most efficiently portion the food product into optimum sizes. For example, a customer may desire chicken breast portions in two different weight sizes, but with no fat or with a limited amount of acceptable fat. The chicken breast is scanned as it moves on an infeed conveyor belt, and the determination is made through the use of the computer as to how to best portion the chicken breast to the weights desired by the customer, with no or limited amount of fat, so as to use the chicken breast most effectively.

Portioning and/or trimming of food products can be carried out by various cutting techniques, including the use of high-speed liquid jet cutters. The liquid used by these jet or beam cutters may include, for example, water or liquid nitrogen. The cutting devices are mounted on actuators to move the cutting devices along the predetermined cutting paths.

To increase throughput, robots are now being used to support and move the cutting devices. The advantages of robots include their speed, accuracy, and durability. However, robots are quite expensive and may be difficult to justify if several robots are required to portion trim a food product, such as a poultry fillet or a beef steak or a pork belly. The present disclosure seeks to address the high cost of robots by utilizing a robot to make at least two independent cuts on either two separate food products being conveyed on a conveyor or on opposite sides or ends of a larger food product, such as a pork belly.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one embodiment of the present invention, an apparatus is provided for independently cutting the opposite sides of a workpiece or two separate workpieces as the workpiece(s) is(are) being conveyed on a conveyance device, the conveyance device defining a transport plane for supporting the workpiece being conveyed by the conveyance device. The apparatus comprises: (a) a cutter assembly comprising a mounting bridge and beam cutters mounted at spaced apart locations on the mounting bridge to direct cutting beams toward the transport plane; (b) an actuator for supporting and moving the mounting bridge above the support plane; and (c) a control system for controlling the operation of the conveyor assembly, the actuator, and the beam cutters to move the beam cutters relative to the workpiece and to operate the beam cutters to independently cut a singular workpiece along two spaced apart cutting paths relative to the workpiece, or independently cut separate workpieces along spaced apart cutting paths, while the workpiece(s) is being transported on the conveyance device.

In any of the embodiments described herein, wherein the beam cutters are selected from the group consisting of water jet cutters and laser cutters.

In any of the embodiments described herein, wherein the cutter assembly further comprises an activator for switching the cutter beam between an activated condition and a deactivated condition, and wherein the control system controls the operation of the activator.

In any of the embodiments described herein, wherein the beam cutter is a water jet cutter, and the activator is selected from the group consisting of a blocker for blocking the water jet, a diverter for diverting flow of water to the water jet cutter, and a switch for preventing flow of water to the water jet.

In any of the embodiments described herein, wherein the control system controlling the operation of the actuator in one or more of the following manners: to position one of the beam cutters ahead of the other beam cutter relative to the upstream direction of the conveyor; to hold one of the cutters stationary while the other cutter is operational to cut the workpiece; to cause one of the cutters to reverse its direction of travel relative to the cutting direction of the cutter while the other cutter is operational to cut the workpiece.

In any of the embodiments described herein, wherein the actuator comprises a first arm having a proximal end pivotable about an upright axis relative to a base and a distal end extending from the base, a second arm having a first end pivotable about the distal end of the first arm and a second end, and a mounting attachment disposed at the second end of the second arm for rotation about an upright axis as well as for movement in the upright direction toward and away from the transport plane.

In any of the embodiments described herein, further comprising a scanner for scanning the workpieces being transported on the conveyor and for generating data with respect to the physical parameters of the scanned workpieces.

In any of the embodiments described herein, wherein the control system utilizes the data generated by the scanner to determine cutting paths along the workpieces for the beam cutters.

In any of the embodiments described herein, wherein the actuator supporting and moving the mounting bridge above the transport plane along the length of the conveyance device, across the conveyance device, and rotatably about an upright axis relative to the transport plane.

In any of the embodiments described herein, wherein the actuator supporting the mounting bridge for movement toward and away from the transport plane.

In any of the embodiments described herein, wherein a plurality of beam cutters are located at least one of the space-apart locations on the mounting bridge.

In any of the embodiments described herein, wherein the control system controlling the beam cutters so that at least two beam cutters follow the same path.

In accordance with another embodiment of the present invention, a cutter assembly is provided for cutting workpieces being conveyed on a conveyance device, the cutter assembly adapted to be supported above the conveyance device by an actuator for moving the cutter assembly relative to the conveyance device. The cutter assembly comprises a mounting bridge, beam cutters mounted at spaced apart locations on the mounting bridge to direct cutting beams toward the conveyance device, and an activator carried by the mounting bridge for switching at least one of the beam cutters between an activated condition and a deactivated condition.

In any of the embodiments described herein, wherein the beam cutters are selected from the group consisting of water jet cutters and beams.

In any of the embodiments described herein, wherein multiple beam cutters are mounted at at least one of the spaced apart locations on the mounting bridge.

In any of the embodiments described herein, wherein the multiple beam cutters are positioned relative to each other laterally of the length of the mounting bridge.

In any of the embodiments described herein, further comprising a control system for controlling the operation of the conveyance device, the activator, and the beam cutters to determine cutting paths for the beam cutters along the workpieces and to move the beam cutters relative to the workpiece, and to operate the beam cutters to independently cut a singular workpiece along two spaced apart cutting paths, or independently cut two separate workpieces along spaced apart cutting paths, while the workpiece(s) (are) is being transported on the conveyance device.

In any of the embodiments described herein, wherein the beam cutter is a water jet cutter, and the activator is selected from the group consisting of a blocker for blocking the water jet, and a valve for preventing water from reaching the beam cutter.

In any of the embodiments described herein, wherein the control system controls the operation of the activator in one or more of the following ways: to position one of the beam cutters ahead of the other beam cutter relative to the upstream direction of the conveyance device; to hold one of the cutters stationary while the other beam cutter is operational to cut the workpiece; to cause one of the beam cutters to reverse its direction of travel relative to the cutting direction of the beam cutter while the other beam cutter is operational to cut the workpiece; and to cause at least two beam cutters to follow the same cutting path.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
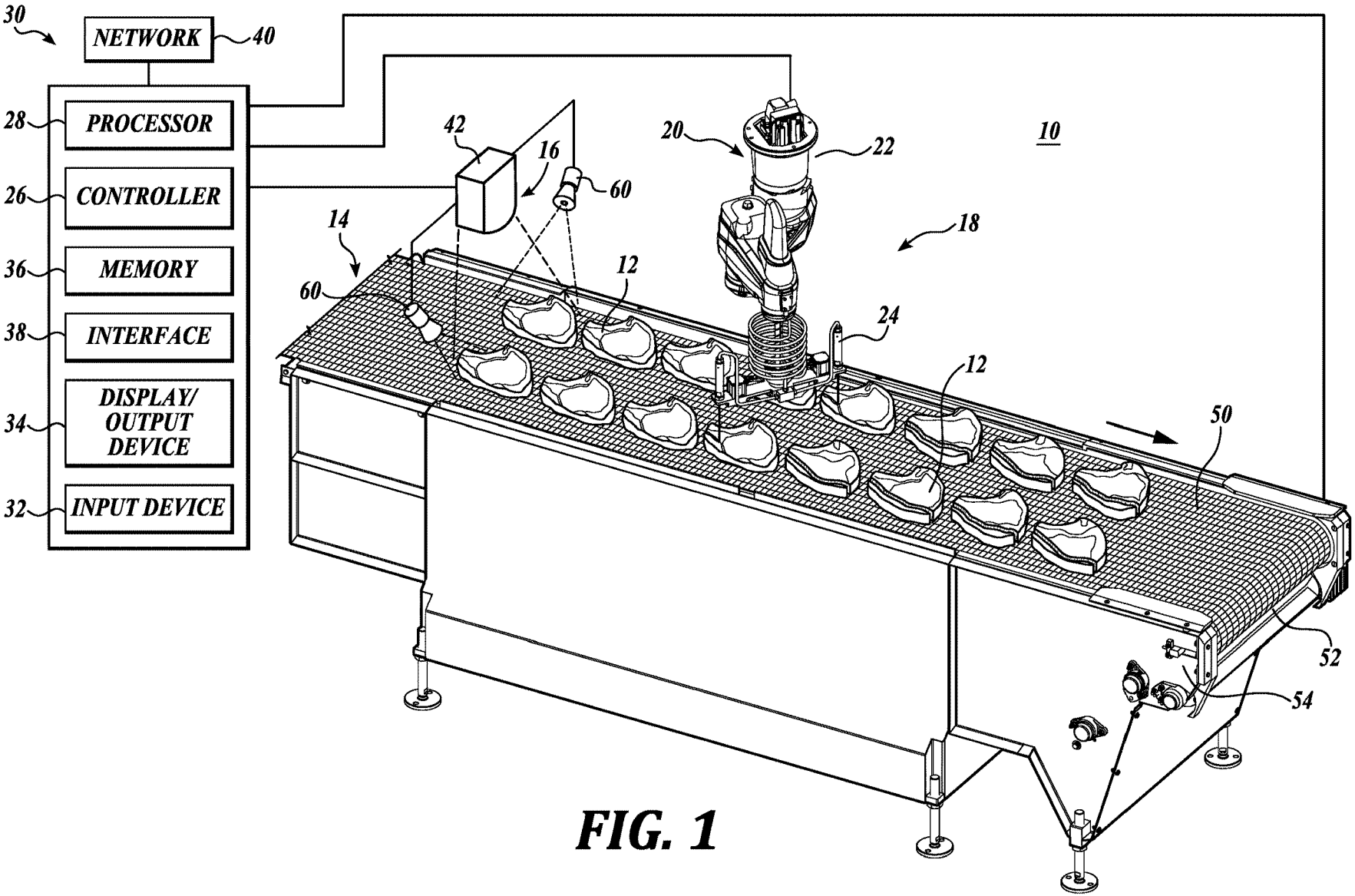
FIG. 1 is an isometric pictorial view of an embodiment of the present disclosure utilizing one robotic actuator to trim steaks disposed along two separate lanes on a conveyor in independent fashion.

The description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result.

In the following description, numerous specific details are set forth in order to provide a thorough understanding of exemplary embodiments of the present disclosure. It will be apparent to one skilled in the art, however, that many embodiments of the present disclosure may be practiced without some or all of the specific details. In some instances, well-known process steps have not been described in detail in order not to unnecessarily obscure various aspects of the present disclosure. Further, it will be appreciated that embodiments of the present disclosure may employ any combination of features described herein.

The present application may include references to "directions," such as "forward," "rearward," "front," "back," "ahead," "behind," "upward," "downward," "above," "below," "top," "bottom," "right hand," "left hand," "in," "out," "extended," "advanced," "retracted," "proximal," and "distal." These references and other similar references in the present application are only to assist in helping describe and understand the present disclosure and are not intended to limit the present invention to these directions.

The present application may include modifiers such as the words "generally," "approximately," "about", or "substantially." These terms are meant to serve as modifiers to indicate that the "dimension," "shape," "temperature," "time," or other physical parameter in question need not be exact, but may vary as long as the function that is required to be performed can be carried out. For example, in the phrase "generally circular in shape," the shape need not be exactly circular as long as the required function of the structure in question can be carried out.

In the following description, various embodiments of the present disclosure are described. In the following description and in the accompanying drawings, the corresponding systems assemblies, apparatus and units may be identified by the same part number, but with an alpha suffix. The descriptions of the parts/components of such systems assemblies, apparatus, and units that are the same or similar are not repeated so as to avoid redundancy in the present application.

In the present application and claims, references to "food," "food products," "food pieces," and "food items," are used interchangeably and are meant to include all manner of foods. Such foods may include meat, fish, shellfish, poultry, fruits, vegetables, nuts, or other types of foods. Also, the present systems and methods are directed to raw food products, as well as partially and/or fully processed or cooked food products.

Further, the system, apparatus, and methods disclosed in the present application and defined in the present claims, though specifically applicable to food products or food items, may also be used outside of the food area. Such examples include fabric, leather, paper, plastic, and wood work products. Accordingly, the present application and claims reference "work products," "work items" and "workpieces," which terms are synonymous with each other. It is to be understood that references to work products and workpieces also include food, food products, food pieces, and food items, as well as, for example, cardboard, fabrics, carpet and upholstery.

The system and method of the present disclosure include the scanning of workpieces, including food items, to ascertain physical parameters of the workpiece comprising the size and/or shape of the workpiece. Such size and/or shape parameters may include, among other parameters, the length, width, aspect ratio, thickness, thickness profile, contour, outer contour, outer perimeter, outer perimeter configuration, outer perimeter size, outer perimeter shape, volume and/or weight of the workpiece. With respect to the physical parameters of the length, width, length/width aspect ratio, and thickness of the workpieces, including food items, such physical parameters may include the maximum, average, mean, and/or medium values of such parameters. With respect to the thickness profile of the workpiece, such profile can be along the length of the workpiece, across the width of the workpiece, as well as both across/along the width and length of the workpiece. Also, the scanning can be used to locate fat or bones with respect to meat or poultry.

As noted above, a further parameter of the workpiece that may be ascertained, measured, analyzed, etc., is the contour of the workpiece. The term contour may refer to the outline, shape, and/or form of the workpiece, whether at the base or bottom of the workpiece or at any height along the thickness of the workpiece. The parameter term "outer contour" may refer to the outline, shape, form, etc., of the workpiece along its outermost boundary or edge.

The parameter referred to as the "perimeter" of the workpiece refers to the boundary or distance around a workpiece. Thus, the terms outer perimeter, outer perimeter configuration, outer perimeter size, and outer perimeter shape pertain to the distance around, the configuration, the size and the shape of the outermost boundary or edge of the workpiece.

The foregoing enumerated size and/or shape parameters are not intended to be limiting or inclusive. Other size and/or shape parameters may be ascertained, monitored, measured, etc., by the present system and method. Moreover, the definitions or explanations of the above specific size and/or shape parameters discussed above are not meant to be limiting or inclusive.

FIG. 1 schematically illustrates a system 10 implementing an embodiment of the present disclosure wherein food products 12 are transported on a moving support surface or transport plane in the form of a conveyor system 14. The food products 12 are arranged in multiple lanes or windrows. The food products 12 are depicted in FIG. 1 as steaks, but can be of numerous types, including pork bellies or chicken breasts, as discussed more fully below. The conveyance system 14 carries the food products 12 past the scanning system 16 for scanning the food products and generating data pertaining to various parameters of the food products, including those discussed above. Thereafter the food products 12 are transported past the processing station 18 for cutting, trimming, portioning, etc. using a cutting apparatus 20 in the form of a robotic actuator 22 onto which is mounted a dual headed cutter assembly 24 capable of independently cutting/trimming/portioning two separate food products 12, for example, located in side-by-side lanes.

The conveyor system 14, the scanning system 16, and the processing station 18, including the robotic actuator 22 and the dual headed cutter assembly 24, are controlled by a controller 26 operated by a processor 28 of a control system 30, as schematically shown in FIG. 1. The control system 30 includes an input device 32 (keyboard, mouse, touchpad, etc.) and an output device 34 (display, printer, etc.). The control system also includes memory unit 36 and an interface 38 for receiving signals and information from the conveyor system 14, scanning system 16, processing station 18, cutting apparatus 20, as well as from other data sources of the system 10, including as described more fully below. The control system 30 may be connected to a network 40. Also, rather than employing the local processor 28, a network computing system can be used for this purpose.

Generally, the scanning system 16 includes a scanner 42 for scanning the food products 12 to produce data relating to or representative of the physical specifications of the food products, and sends such data to the control system 30. The control system, using a scanning program, analyzes the scanning data to determine the location or locations of the food products 12 on the conveyance system 14 and develops physical parameters of the scan food products, including for example the length, width, area and/or volume distribution of the scanned food products. The processor 28 may also develop a thickness profile of the scanned food products, as well as the overall shape and size of the food products.

The control system can then model the food products to determine how the food products may be trimmed, divided, or otherwise cut in accordance with desired physical criteria, including, for example, the shape, area, weight, thickness, fat content, etc. of the food products. The control system 30, using the scanning program and/or a cutting or portioning program, determines how the food products are to be trimmed or otherwise cut. The control system then functions to control the cutting apparatus 20 trim or cut the food products 12 in accordance with the desired physical parameters mentioned above.

Next, describing the system 10 in more detail, the conveyance system 14 includes a powered belt 50 that slides over an underlying support or bed 52. The belt 50 defines a transport or support surface/plane for supporting the food products for travel along the conveyance system 14. The belt 50 is driven by drive rollers (not shown) mounted on a frame structure 54 that also supports the conveyor bed 52. The drive rollers are driven at a selected speed by a drive motor (not shown) in a standard manner. The drive motor can be composed of a variable speed motor, and thus adjust the speed of the belt as desired as the food products 12 are carried past the scanning system 16, the processing station 18, including the cutting apparatus 20.

An encoder, not shown, is integrated into the conveyor system 12, for example, at the drive rollers, to generate electrical pulses at fixed distance intervals corresponding to the forward movement of the conveyor belt 50. This information is routed to the control system 30 so that the location(s) of the food products 12 can be determined and monitored as the food products travel along the conveyor system 14. This information can be used to position the cutter assembly 24 as well as the movement of the robotic actuator 22.

The scanning system 16 can be of various configurations or types, including a video camera (not shown) to view the food products illuminated by one or more light sources 60. Light from the light sources 60 is extended across the moving conveyor belt 50 to define a sharp shadow or light stripe line projected across the conveyor, with the area forwardly of the transverse beam being dark. When no food product 12 is being carried by the conveyor belt 50, the shadow of the light stripe forms a straight line across the conveyor belt. However, when a food product 12 passes across the shadow line/light stripe, the upper, irregular surface of the food product produces an irregular shadow line/light stripe as viewed by the video camera angled downwardly on the food product and the shadow light/light stripe. The video camera directs the displacement of the shadow line/light stripe from the position it would occupy if no food product were present on the conveyor belt 50. This displacement represents the thickness of the food product 12 along the shadow line/light stripe. The length of the food product is determined by the distance along the belt travel that the shadow line/light stripes are created by the food product. In this regard, the encoder, which is integrated into the conveyance system 14, generates pulses at fixed distance intervals corresponding to the forward movement of the conveyor belt 50.

In lieu of a video camera, the scanning system 16 may instead utilize an X-ray apparatus (not shown) for determining the physical characteristics of the food product 12, including its shape, mass, and weight. X-rays may be passed through the object in the direction of an X-ray detector (not shown). Such X-rays are attenuated by the food product in proportion to the mass thereof. The X-ray detector is capable of measuring the intensity of the X-rays received by the detector, after passing through the food product. This attenuation is utilized to determine the overall shape and size of the food product 12 as well as its mass. An example of such an X-ray scanning device is disclosed in U.S. Pat. No. 5,585,605, incorporated by reference herein.

The foregoing scanning systems are known in the art, and thus are not novel per se. However, use of these scanning systems in conjunction with other aspects of the described embodiments is believed to be new.

The data and information measured/gathered at the scanning system 16 is transmitted to the control system 30, which records and/or notes the location of the food products on the conveyor belt 50 as well as data pertaining to physical parameters of the food products as discussed above. With this information, the processor 28, operating, for example, under the scanning system software, can develop an area profile as well as a volume profile of the food products. Knowing the density of the food products, the processor can also determine the weight of the food products or segments or sections or portions thereof. The processor can also determine the size and location of fat and hones in various food products, for example, meat or poultry.

Although the foregoing description discusses scanning by use of a video camera and a light source as well as by use of X-rays, other three-dimensional scanning techniques may be utilized. For example, such additional techniques may be by ultrasound or mire fringe methods. In addition, electromagnetic imaging techniques may be employed. Thus, the present invention is not limited to the use of video cameras or X-ray methods but encompasses other two- and three-dimensional scanning technologies.

In system 10, the food products 12 can be processed in various ways. One example is illustrated in FIG. 1 wherein individual food products 12 are processed by trimming fat from the food products at processing station 18. The conveying system 14 carries the food products 12 past the processing station 18 whereat two food products 12 in separate lanes are trimmed at the same time and on an individual basis using a dual headed cutter assembly 24 operated by a single robotic actuator 22.

Figure 2:
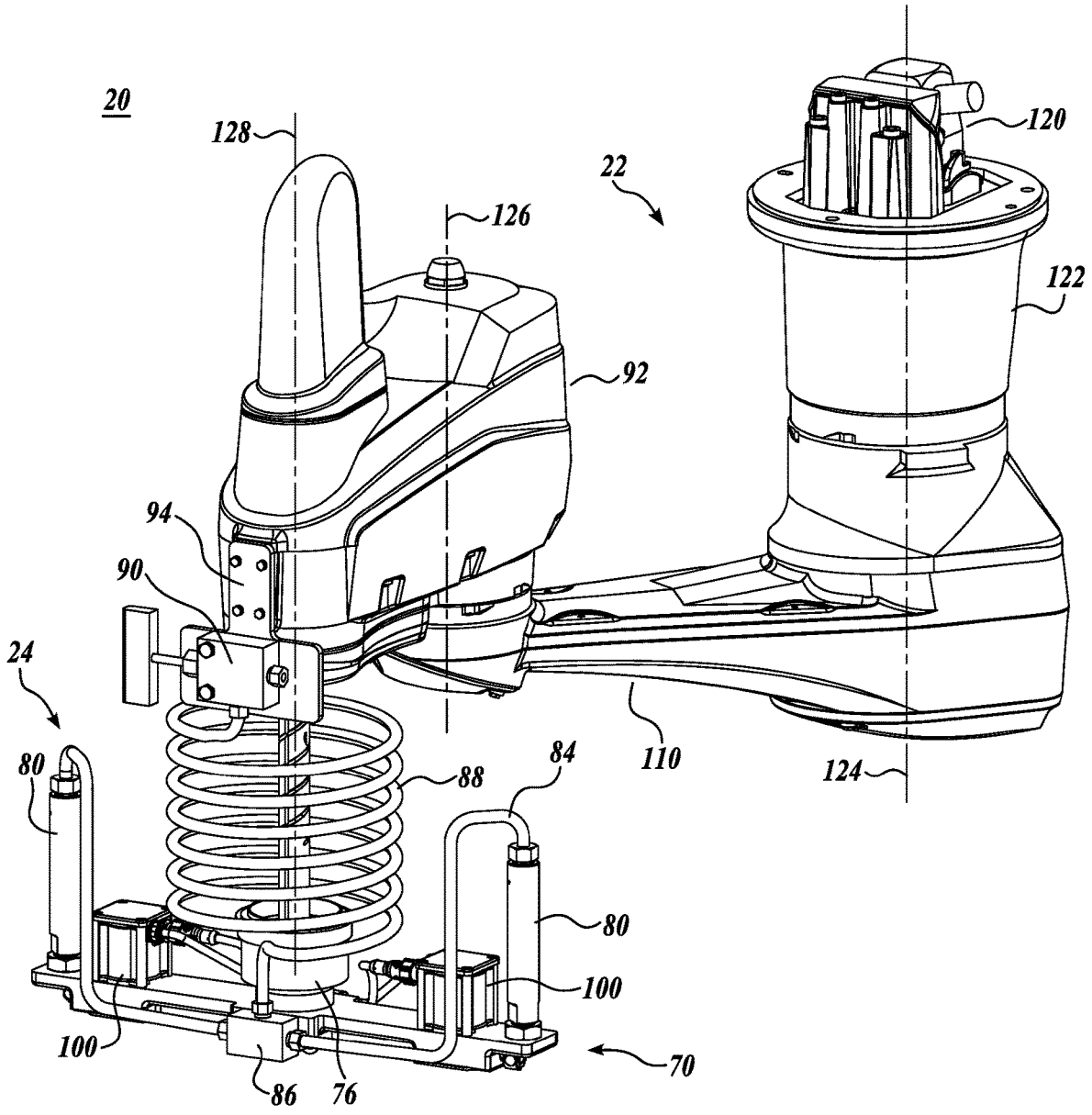
FIG. 2 is an enlarged isometric view of a portion of the robotic actuator and dual headed cutter assembly of FIG. 1.
Figure 3:
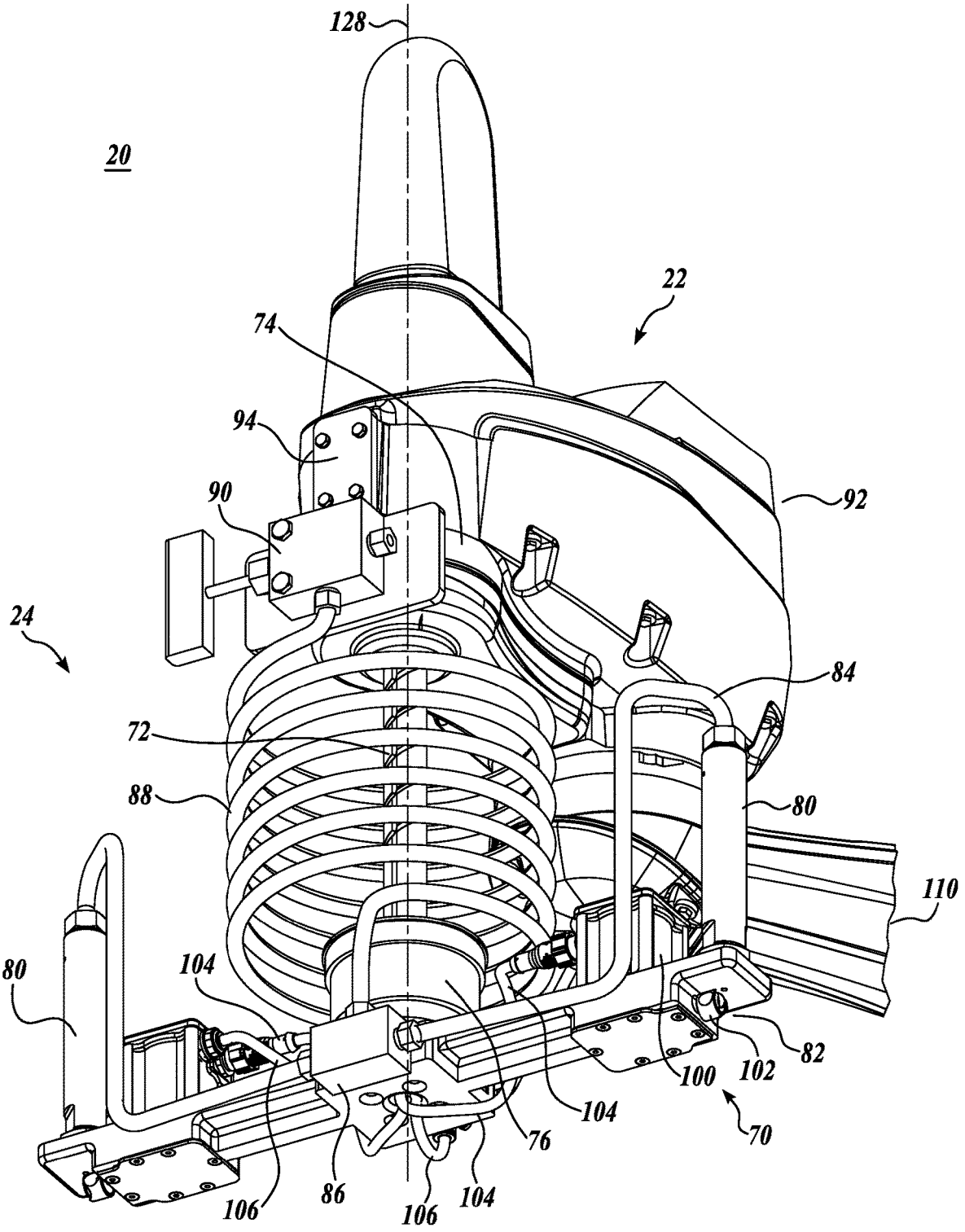
FIG. 3 is a view of the robotic actuator and dual headed cutter assembly of FIG. 2 taken from the underside thereof.

Referring specifically to FIGS. 2 and 3, the cutting apparatus 20 includes an elongate bridge or beam structure 70 mounted on the lower end of an actuating shaft 72 depending downwardly from an actuator head 74 of the robot actuator 22. A connector 76 is mounted centrally on the upper side of the bridge structure 70 for connecting the bridge structure to the lower end of the actuating shaft 72. Water jet cutters 80 are mounted at spaced-apart locations on the bridge structure 70. Although such locations are depicted in FIGS. 2 and 3 at the end portions of the bridge structure, the water jet cutters 80 can be positioned at other locations on the bridge structure. The water jets produced by the cutters 80 project through vertical openings formed in the bridge structure 70. High pressure water is supplied to the upper ends of the water jet cutters 80 by feed lines 84 that are connected to a tee connector 86 mounted centrally on the bridge structure 70.

The high pressure water is routed to the tee connector 86 through a coiled delivery line 88 that wraps around the actuating shaft 72. It will be appreciated that the coiled delivery line 88 enables the bridge structure 70 to be rotated, as discussed more fully below, without restriction. Also, the coiled delivery line 88 enables the bridge structure to be raised and lowered relative to the actuating head 74, thereby to vertically position the bridge structure 70 at a desired location relative to the conveyor belt 50. The feed or inlet end of the coiled delivery line 88 is connected to a junction block 90 that is mounted on the distal end of the robot second arm 92 via a mounting bracket 94 extending upwardly from the junction connector 90 for attachment to the distal end of the robot second arm 92 via hardware members or other appropriate means. The junction connector is connected to a source of high pressure water.

Continuing to refer specifically to FIGS. 2 and 3, actuators 100 are also mounted on the bridge structure 70 to control the operation of the water jet cutters 80 between an activated or cutting condition and a deactivated for not cutting condition. As discussed more fully below, each of the water jets 80 are independently operated and controlled so as to be able to cut two separate food products 12 in an independent fashion, or to cut the opposite sides of a larger workpiece, such as a pork belly, also in an independent fashion. In these situations, at certain times only one of the cutters may be cutting while the other cutter is deactivated. The actuator 100 controls whether or not a cutting beam is emanating from a cutter 80. Referring to FIG. 3, the actuator 100 includes a blocking structure 102 projecting horizontally outwardly from the actuator at a location beneath the bridge structure 70. The blocking structure 102 is able to swing in a horizontal arc to block the water jet emanating from the water jet cutter 80 when desired.

The actuator 100 can take a different form than that of the blocking structure 100. For example, the actuator can be in the form of a valve to stop the flow of the high pressure water to the jets when not needed. Such valves are articles of commerce.

Control signals are routed to the actuator 100 through electrical lines 104. Also, cooling air is routed to the actuator 100 through lines 106. The lines 104 and 106 emanate from connector 76. The electrical feed and cooling air can be routed to connector 76 through the interior of the actuating shaft.

Although the cutting apparatus 20 is illustrated and described as utilizing water jet cutters 80, other types of cutters, such as lasers, may be used instead. Further, although the bridge structure 70 is illustrated and described as being of a fixed length so that the water jet cutters 80 are a fixed distance apart, it will be appreciated that the bridge structure could be constructed so that the distance separating the water jets can be adjusted or varied. One reason for doing so is to adapt the cutting apparatus to the lateral distance across the conveyor belt at which the food pieces 12 are located or to adapt to the size of the workpieces when the cutting apparatus 20 is being utilized to cut or trim opposite sides of the food piece at the same time.

Still referring specifically to FIGS. 2 and 3, the robot actuator 22 is constructed with a first or inward arm 110 that is mounted on a base unit, not shown, which in turn may be carried and supported by the conveyor frame structure 54 or by other means. A motor 120 is disposed within a housing 122 for rotating the inward or proximal end of arm 110 about a vertical axis 124. The motor 120 can be of various types, including electrically or pneumatically powered, to operative the inward arm 110 at very high speeds.

As noted above, the robotic actuator 22 also includes an outward or second arm 92 rotatably coupled to the distal end of the first or inward arm 110 about an axis 126. A motor, not shown, is incorporated into the proximal end of the inward arm thereby to rotate the second arm at very high speeds relative to the distal end of the first or inward arm 110.

The actuator head 74, noted above, is rotatably mounted on the distal end of the second or outward arm 92 to rotate about a vertical axis 128 at very high speeds, as well as optionally to be raised and lowered relative to the elevation of the conveyor belt 50. This vertical movement can be accomplished by use of a rotary actuator and a lead screw or by other fast operating equipment. Such vertical movement, if provided, can vary the distance between the bridge structure 70 and the conveyor belt 50 to accommodate, for example, the thickness of food products being trimmed by system 10. In this regard, the vertical position of the bridge structure 70 can be dynamically altered as the thickness profile or vertical contour of a food product changes, for example, the thickness of a pork belly or poultry breast being trimmed or otherwise cut.

The robotic actuator 22 is illustrated as having four degrees of freedom via rotation about vertical axes 124, 126, and 128 as well as vertical movement along the heights of the axis 124 and/or 128. It is to be understood that the robotic actuator 22 can be configured with at least six degrees of freedom, including the ability to rotate the actuator head about two axes extending substantially parallel to the horizontal. With this additional movement, the water jet cutters 80 could be tilted about horizontal relative to the surface or plane of the conveyor belt 50. Further, the robotic actuator can be simplified so as to not provide vertical movement along the heights of axis 124 and/or 128.

Next, describing the use of system 10 to trim workpieces 12 arranged in two side-by-side lanes along conveyor belt 50, the workpieces are illustrated as being in the form of steaks that are to be trimmed to remove excess fat, which typically occurs along one side edge portion of the steaks. As noted above, the steaks are arranged in two rows or lanes along the length of the conveyor belt 50. The steaks may be arranged generally laterally side by side, but that is not a necessity.

The workpieces are carried past scanning system 16 when traveling on the conveyor belt 50. As noted above, at the scanning station 16, information or data (in electronic form) concerning the physical parameters/characteristics of the workpieces 12 is obtained, including the size, shape, and the location of the workpieces on the conveyor belt. Such characteristics or parameters may include, for example, a contour, outer or exterior contour profile, perimeter, outer perimeter condition, outer perimeter size, outer perimeter shape, as well as the location of fat on the steaks, including the quantity of fat. The electronic data or information from the scanning system is transmitted to the control system 30, which utilizes this information to generate a two-dimensional model or three-dimensional model of the workpieces 12. The model includes the location of the fat on the workpieces. The controller determines how the fat on the steaks are to he trimmed using algorithms and criteria stored in the memory 36 of the control system. The controller transforms this information to control instructions for the robotic actuator 22 and cutting apparatus 20. In this regard, the controller controls the cutting path of the water jet cutters 80. To this end, the controller controls the movement of the bridge structure 70 in the X and Y directions relative to the moving conveyor belt 50. This is accomplished by controlling the rotation of the robot inner arm 110 about axis 124, the rotation of the outer robot arm 92 about rotational axis 126 as well as the rotation of the actuator 74 about vertical axis 128.

Further, the controller in addition to determining the movement of the bridge structure 70, also controls the activation and deactivation of the water jet cutters 80 so that the water jet cutters are able to trim the steaks along both lanes or rows independently of each other.

As will be appreciated, the cutting path of the two water jet cutters 80 will be different for each of the steaks 12. In this regard, the cutting path of one of the water jet cutters 80 is not tied to the cutting path of the other water jet cutter 80. The controller is able to control the movement of the bridge structure 70, and thus the positions of the water jet cutters 80, along independent, laterally spaced cutting paths for each of the water jet cutters so that each cutter is capable of trimming different steaks in different rows. In this regard, the water jet cutters 80 may be cutting two different steaks at the same time, or if one of the water jet cutters is traveling from one steak to the other, the water jet cutter may be disabled while the other cutter remains operational.

As shown in FIG. 1, one of the water jet cutters 80 functions as the leading cutter while the other cutter functions as the trailing cutter, with the bridge structure 70 diagonally disposed relative to the length of the conveyor 50. As such, the distance separating the two water jet cutters 80 on the bridge structure 70 is a distance greater than the nominal distance across the conveyor 50 from one steak to the other steak, with respect to the same relative sides of the steaks. It will be appreciated that by locating the water jet cutters 80 at greater distance from each other relative to the side-by-side distance separating the steaks, the water jet cutters 80 are able to follow a desired cutting path along the steaks in an independent mariner. It will also be appreciated that while one of the water jet cutters is trimming a steak, the other water jet cutter may not be moving forwardly along a cutting path, but may be stationary or actually may be moving reverse in direction along its cutting path depending on cutting path of the operational water jet cutter. When such water jet cutter is stationary or moving in reverse direction, the water jet cutter may be deactivated so as to terminate the flow of the high speed water jet emanating from that particular cutter.

It will be appreciated that the extent to which the distance separating the water jet cutters 80 from each other relative to the nominal lateral distance separating the workpieces may range from, for example, 1.25 to 3 times the lateral distance separating the workpieces. In one specific non-limiting example, the distance separating the water jet cutters 80 may be approximately 2 times the nominal lateral distance separating the workpieces 12.

Once the workpieces have been trimmed, the workpieces and/or the trim may be removed from the belt using various techniques, including robots or other equipment for picking up the trimmed workpiece and/or the trim for removal.

Figure 4:
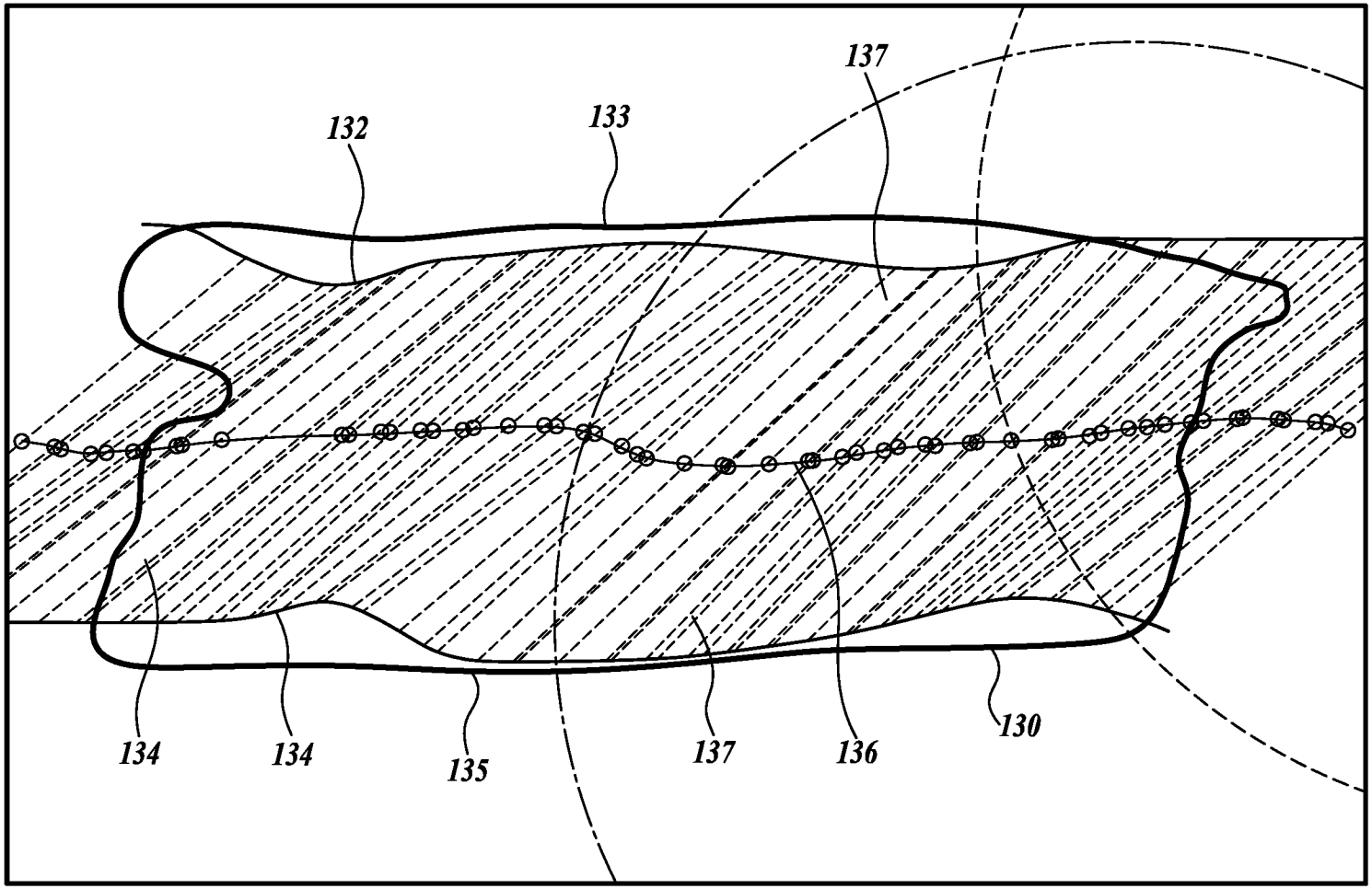
FIG. 4 illustrates a cutting pattern wherein the system of FIG. 1 is utilized to trim the sides of a pork belly.

FIG. 4 illustrates the use of system 10 to trim a pork belly 130. The pork belly 130 is trimmed along its side edges prior to being pressed so that when reshaped in pressing the pork belly assumes a substantially rectangular shape. To this end, if a section of the pork belly shows that the thickness of the pork belly is greater than the average thickness of a pork belly, then more of the pork belly may be trimmed off so that when the pork belly is pressed it does not fracture, crack, or split. On the other hand, if a section of the pork belly is of a thickness less than average, the trimmed width of the pork belly may be increased relative to the nominal width of the pork belly so that additional mass is available to increase the thickness of the pork belly in such location when the pork belly is pressed, for example, from side to side. The trimming of pork bellies to achieve a rectangular shape after pressing and without causing damage to the pork belly from fracturing, cracking, or splitting when pressed is discussed in applicant's prior filed Application No. 62/966,429, incorporated herein by reference.

FIG. 4 shows the cutting path 132 (shown on the upper side of FIG. 4) along the corresponding edge 133 of the pork belly and a cutting path 134 extending along the opposite side 135 of the pork belly 130. As apparent, the width across the pork belly separating cutting paths 132 and 134 differs along the length of the pork belly 130. Nonetheless, the cutting system 10 of the present disclosure is capable of utilizing a singular robot actuator 22 to cut both sides of the pork belly in an independent manner. In this regard, the cutting path 132 of one of the water jet cutters 80 is not tied to the cutting path 134 of the other water jet cutter 80.

In FIG. 4, the diagonal lines 137 represent the orientation of the bridge structure 70 as the bridge structure moves relative to the pork belly. The center line 136 represents the center of the bridge structure, and thus the path of the vertical axis 128 extending along the length of the pork belly. As shown in FIG. 4, the angularity of the bridge structure 70 changes along the length of the pork belly, and the location of the center of the bridge structure 70 (represented by axis 128) relative to the width of the pork belly also changes as the bridge structure travels along the length of the pork belly.

One exemplary, but not limiting, example of determining the path 136 of the center of the bridge structure 70, as well as the angularity of the bridge structure is as follows. The predetermined cutting path 132 can be divided into equal segments along the cutting path. An arc having a radius corresponding to the distance separating the water jet cutters 80 along the length of the bridge structure 70 is drawn or swung relative to the cutting path 134 to intersect such cutting path. In this manner, the angularity of bridge structure 70 is determined. Also, the location of the center of the bridge structure is determined by the mid-point of such line between the intersection of the upper cut path 132 and the intersection of the lower cut path 134.

As will be appreciated from FIG. 4, the water jet cutter 80 along the upper cut path 132 may travel at different relative speed with respect to the water jet cutter 80 moving along the lower cut path 134. At certain times, the water jet cutter 80 along the upper cut path 132 may be traveling at a faster speed than the water jet cutter traveling along the lower cut path 134 or vice versa. Such change in relative speed results in a change of the angular orientation of the bridge structure relative to the length of the pork belly 130. The foregoing capabilities of the cutting apparatus 20 enables both sides of the pork belly to be cut using a singular robot which carries and controls the bridge structure 70 as well as the operation of the water jet cutters 80. Also, as discussed above, the distance separating the water jet cutters on the bridge structure 70 is greater than the width of the pork belly 130, For example, the distance separating the water jet cutters can be from 10% to 15% greater than the width of the pork belly. As another example, the distance separating the water jet cutters can be from 20 to 25% greater than the width of the pork belly.

As such, one of the water jet cutters 80 always assumes the position of the leading cutter whereas the other of the water jet cutters always assumes the function or location of the trailing cutter.

Figure 5:
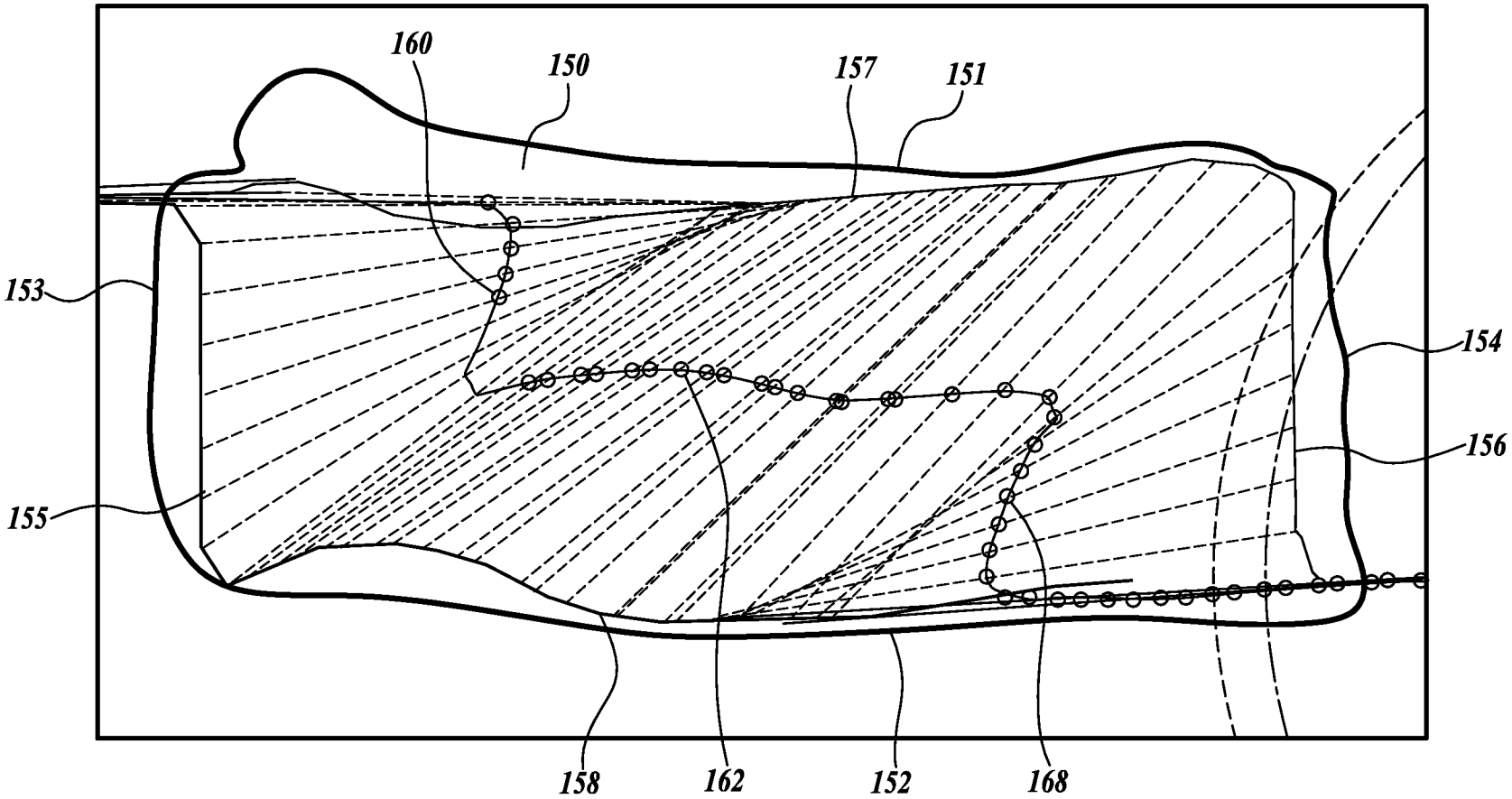
FIG. 5 is a view similar to FIG. 4 wherein the system of the present disclosure is utilized to cut the sides as well as the ends of a pork belly.

FIG. 5 illustrates another cutting pattern utilizing the system 20 of the present disclosure to cut a pork belly 150 along not only the side portions 151 and 152 of the pork belly but also along the ends 153 and 154 of the pork belly. The path of the water jet cutters 80 is established in a manner similar to that described above with respect to FIG. 4. However, to create the transverse cuts 155 and 156 along the ends of the pork belly, vertical cutting paths are established.

At the left hand end 153 of the pork belly 150 shown in FIG. 5, corresponding to the trailing water jet cutter, the determined vertical cut path 155 is divided into segments and then arcs are swept from each such location of the vertical path 155 along the upper cutting path 157. As can be appreciated, as the water jet cutter is cutting downwardly along vertical end path 155, the opposite end of the bridge structure actually travels in reverse direction (in the left hand direction in FIG. 5) until the water jet cutter reaches the bottom path 158 to be cut from the pork belly. Thereupon, both of the water jet cutters travel in the right hand direction shown in FIG. 5 along the cutting paths 157 and 158. During the cutting of the left hand end of the pork belly along cutting path 155, the center of the bridging structure follows path 160 and thereafter, after completion of the vertical cut 155, the center of the bridging structure follows path section 162, which travels generally longitudinally of the length of the pork belly.

To cut the end of the pork belly 154 along path 156, this vertical path is divided into equally spaced segments and then the location of the trailing cutter along the lower cut path 158 is ascertained in a manner described above. As will be appreciated, as the leading cutter cuts the vertical path 156, the trailing water jet cutter will actually he moving in reverse direction along lower path 158 until the vertical path 156 has been completed. It will also be appreciated that the path of the center of the bridging structure does not follow the centerline of the pork belly 150, but moves in a complex path based on the movement of the water jet cutters as the sides and ends of the pork belly are trimmed or otherwise cut.

As will be appreciated, FIG. 5 illustrates how not only the sides 151 and 152 of the pork belly 150 may be cut, but also how the ends 153 and 154 of the pork belly are cut using a singular robot actuator, and a bridge structure 70 having a water jet cutter at spaced apart locations on the bridge structure, for example, at each of its ends. Typically, a pork belly such as that shown in FIG. 5 are trimmed using two separate water jet cutters each mounted on a separate robot or actuator. The system 10 of the present disclosure allows a singular robot to be utilized thereby greatly reducing the expense of an apparatus for trimming pork bellies.

As is the situation in FIG. 4, the length of the distance separating the water jet cutters 80 on the bridge structure 70 is greater than the width of the pork belly 150 so that one of the water jet cutters 80 is always a leading cutter and the other of the water jet cutters is always the trailing cutter. As noted above, the distance separating the water jet cutters 80 on the bridge structure 70 can be from at least 1.1 to 1.25 times longer than the width of the pork belly 150.

FIGS. 11A-11F illustrate a cutting pattern utilizing the system 20 of the present disclosure, including cutting beam 70, to cut pork belly 150' into rectangular shape rather than the shape shown in FIG. 5. In this regard, the cutting procedure is very similar to that described above with respect to FIG. 5, but instead of upper and lower curvilinear cutting paths 157 and 158, in FIGS. 11A-11F the upper and lower cutting paths 157' and 158' are in substantially straight lines. As such, the cutting process will not be repeated here, and the same part numbers are utilized in FIGS. 11A-11F as in FIG. 5, but with the addition of a prime (') designation. The position of the cutting beam 70 is shown as the beam progresses from FIG. 11A to FIG. 11F.

Figure 12:
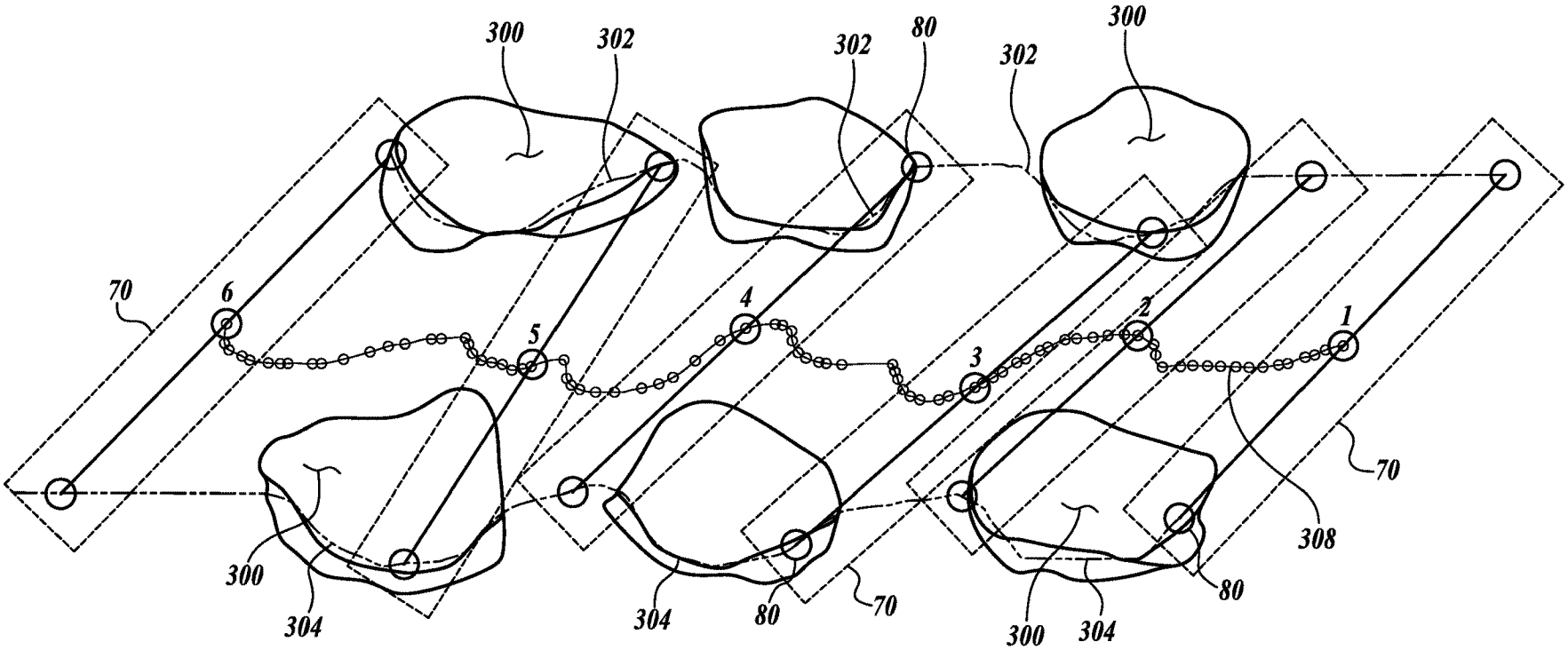
FIG. 12 is a view similar to FIG. 4 illustrating the use of one of the cutters trim workpieces in the form of, for example, steaks.

FIG. 12 illustrates the trimming/cutting of steaks 300 using the cutters 80 of the cutting apparatus 20, similar to the trimming/cutting shown in FIG. 1. Cutting paths 302 and 304 are shown extending along the lower sides of the steaks which are arranged in two rows on a conveyor.

The position and orientation of the bridge structure 70 changes as the steaks move from left to right on a conveyor, as shown in FIG. 12. The center line 308, designated by circles, represents the center of the bridge structure 70, and thus the path of the vertical axis 128 extending along the conveyor between the two rows of steaks. As shown in FIG. 12, the angularity of the bridge structure 70 changes, and the location of the center of the bridge structure 70 (represented by axis 128) also changes relative to the width separating the two rows of steaks, while the steaks are being trimmed by the cutters 80 as the cutters follow trim paths along the steaks. In this manner, the steaks of each row are trimmed/cut at the same time, but such trimming/cutting of a steak in one row is independent of the trimming/cutting of the steak of the other row.

Next, referring to FIGS. 6, 7, 8, and 9, a further embodiment of the present disclosure is illustrated wherein bridge structure 70' includes a singular water jet cutter 80 at one end and a water jet cutter 180 with two side-by-side nozzles 182 at the opposite end of the bridge structure 70'. In FIGS. 6-9, the components that are the same or very similar to those of FIGS. 1-5 are identified with the same part number. Further, components that correspond to those shown in FIGS. 1-5 are identified with the same part number but with a prime ("') designation.

Figure 7:
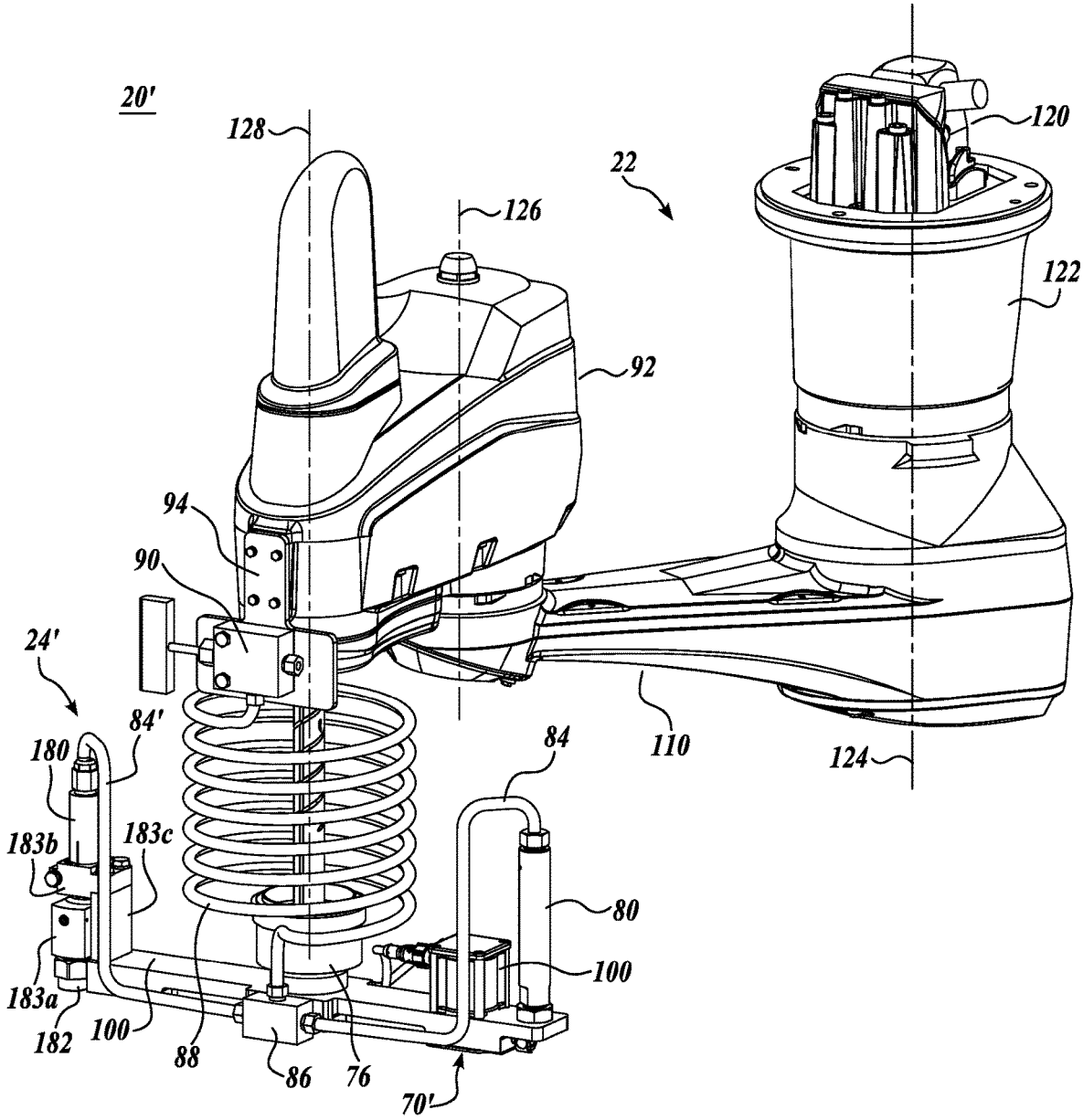
FIG. 7 is a view similar to FIG. 2 illustrating a different configuration of a cutter assembly.
Figure 8:
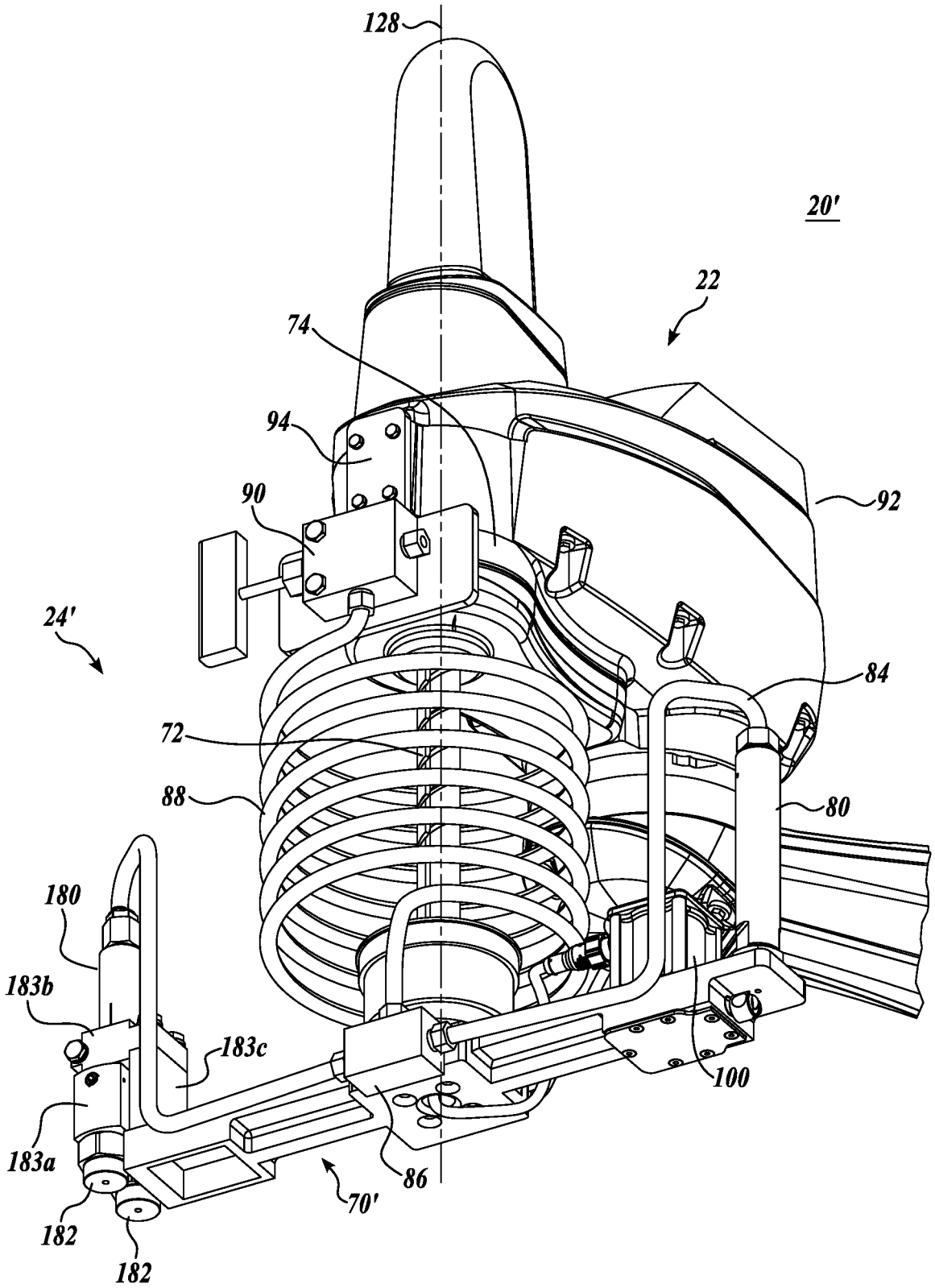
FIG. 8 is a view similar to FIG. 3 illustrating the alternative embodiment of the cutter assembly.

As shown in FIGS. 7 and 8, the water jet cutter 180 includes two laterally spaced apart outlet nozzles 182 projecting from an outlet manifold 183*a* depending downwardly from an overhead base structure 183*b*, which is mounted to the adjacent end of the bridge structure 70' by an upwardly extending mounting block 183*c*. Except for the construction of the water jet cutter 180, the bridge structure 70' can be the same as bridge structure 70 described above. Also, the other aspects of the cutter assembly 24' shown in FIGS. 7 and 8 is the same as the cutting assembly 24 shown in FIGS. 1-5.

Figure 6:
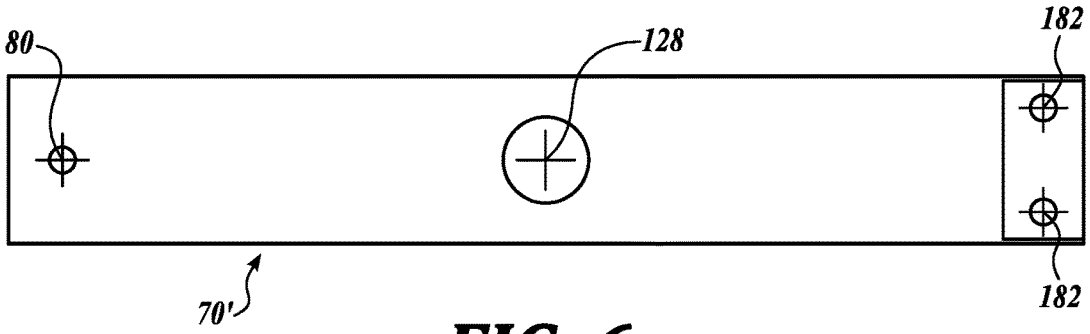
FIG. 6 is a top schematic view of a portion of a dual headed cutter assembly showing the locations of the cutting jets.

FIG. 6 schematically illustrates the relative position and the nozzles 182 of the water jet cutter 180. Although not essential, the water jet cutter 80 is spaced from vertical axis 128 the same distance that the outlet nozzles 182 are spaced from the axis 128, along the length of the bridge structure 70'.

Figure 9:
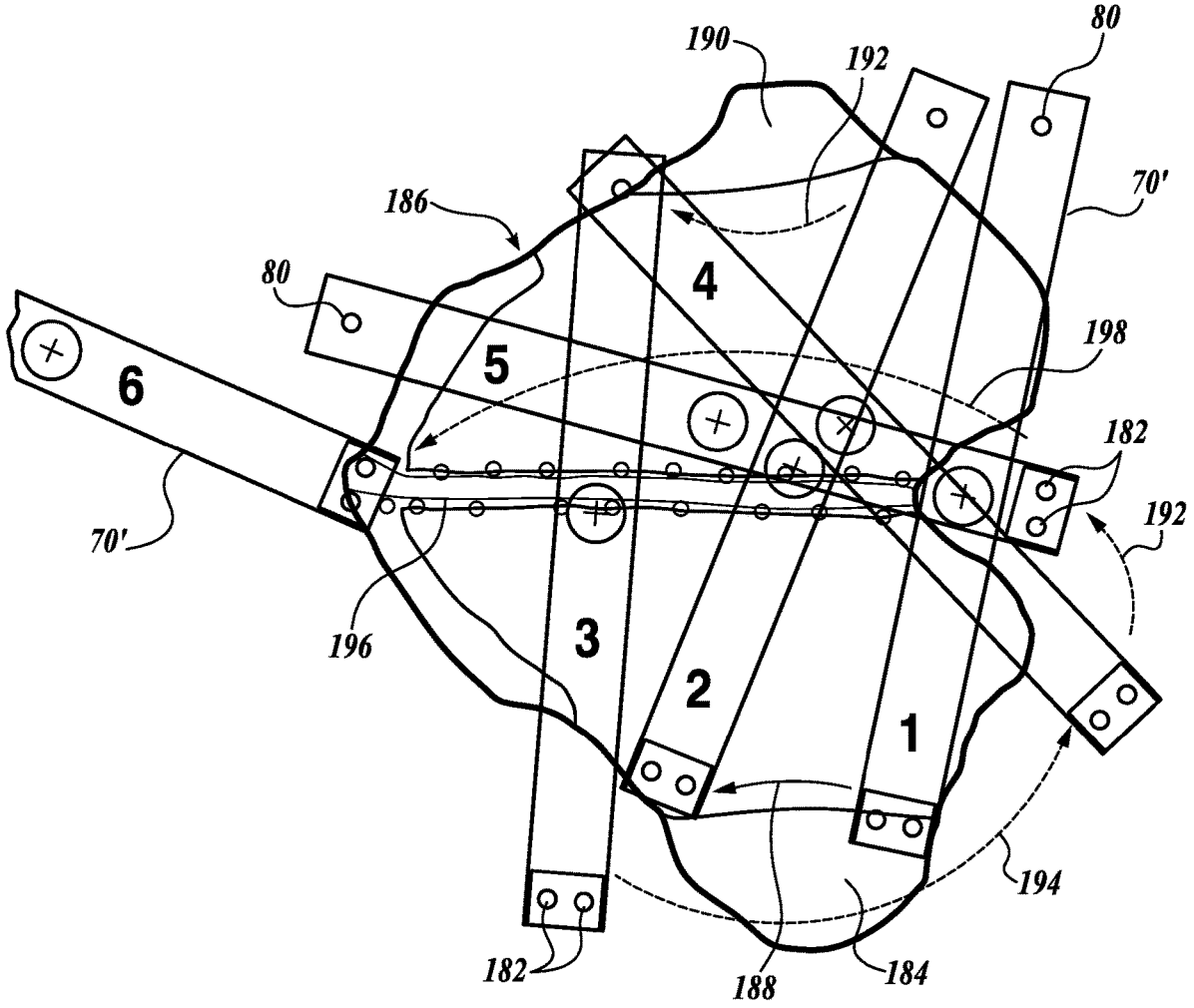
FIG. 9 shows a cutting pattern wherein the cutter assembly of FIGS. 6, 7, and 8 is used to trim a poultry breast.

One purpose of the cutting apparatus 20' of FIGS. 6-9 is to enable a singular robot to be used to efficiently trim the chicken breasts as well as to remove the keel strip from the center of the chicken breast. In this regard, the cutting sequence and positions of the bridge structure 70' is shown in FIG. 9. The cutting sequence at position 41 shows the singular water jet cutter 80 in position to cut the ear section or rib meat 184 from the chicken breast 186. Arrow 188 shows the path of the water jet nozzles 182 that perform the cutting operation.

Cutting sequence #2 shows the use of the water jet cutter 80 to cut the ear section or rib meat 190 from the opposite side of the chicken breast 186. The travel path of the water jet cutter 80 is illustrated by arrow 192.

Sequence #3 shows the position of the bridge structure 70' after completion of the trimming of the upper and lower ear sections 184 and 190 from the chicken breast 186.

Thereafter, the end of bridge structure 70' corresponding to nozzles 182 is rotated in a counter-clockwise direction represented by arrow 194, and also the center of the bridge structure is moved to the right hand direction so that the nozzles 182 are beyond the envelope of the chicken breast 186 into position #4.

The bridge structure 70' is further rotated in a counter-clockwise direction as shown by arrow 192 so that the bridge structure is in the position #5. Thereafter, the bridge structure is moved in the left hand direction wherein the nozzles 182 straddle the keel 196 of the chicken breast. See arrow 198, In this manner, the keel 196 is severed from the chicken breast by the nozzles 182. Upon completion, the bridge structure 70' is in position #6, shown in FIG. 9.

It will be appreciated that a single robot utilizing bridge structure 70' having one water jet cutter at one end and two laterally spaced water jet nozzles at the opposite end may be utilized to efficiently trim the ears from a chicken breast as well as to sever the keel from the chicken breast in a very fast and efficient process. It will also be appreciated that to carry out the trimming of the ears and the severing of the keel, the cutting paths of the water jet cutter 80 and nozzles 182 are independent of each other, and the center of the bridge structure '70 is not restricted to move along the center of the chicken breast.

Figure 13A:
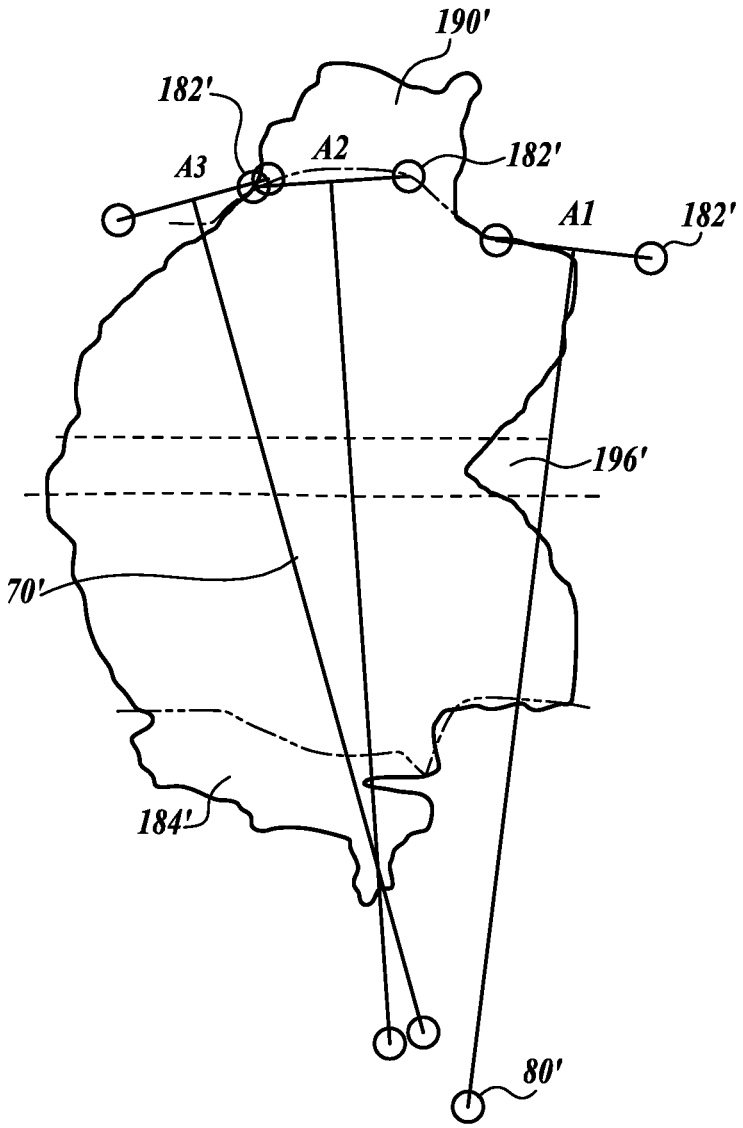
FIGS. 13A, 13B, and 13C show views similar to FIG. 9 illustrating the trimming of a poultry breast utilizing cutter assembly shown in FIGS. 6, 7, and 8.
Figure 13B:
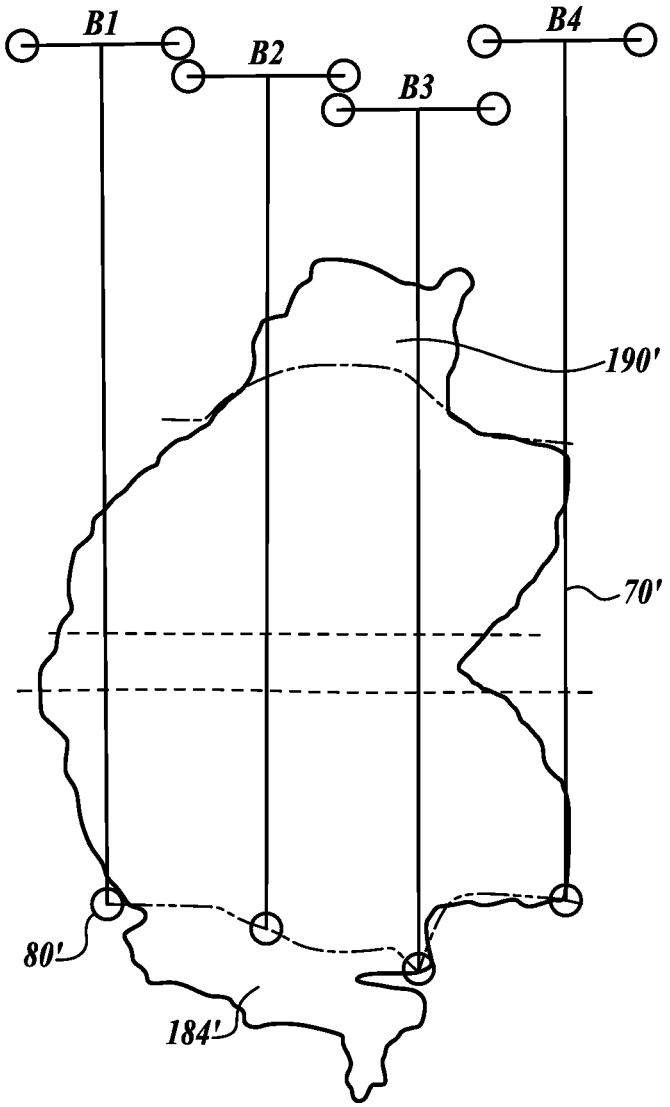
Figure 13C:
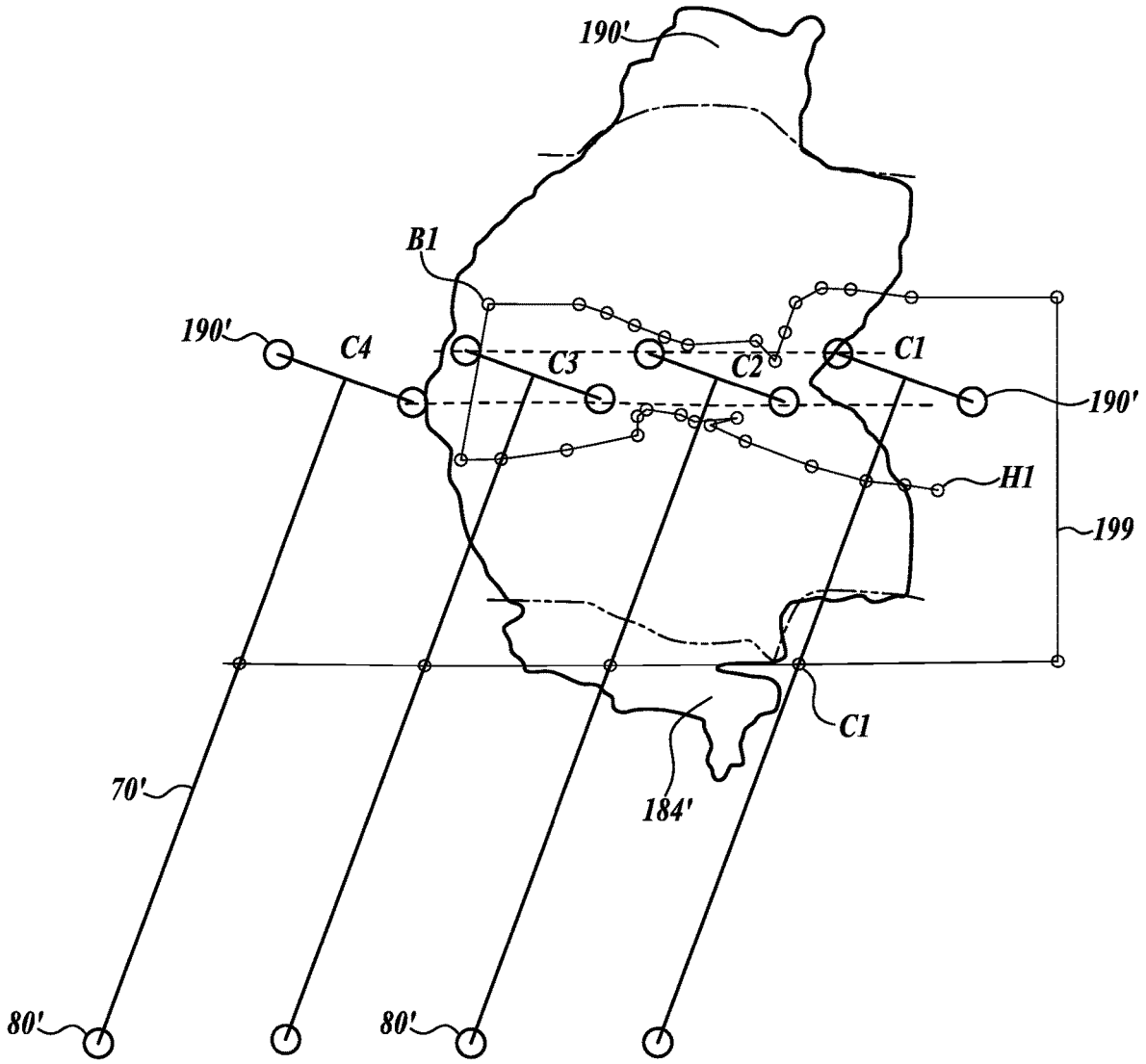

FIGS. 13A, 13B, and 13C illustrate another example of removing the keel strip 196' and the ear sections or rib meat 184' and 190' from a poultry breast 186' wherein the two nozzles 182' are positioned in the opposite location relative to that shown in FIG. 9. In this regard, the part numbers utilized in FIGS. 13A-13C are the same as in FIG. 9 but with the addition of a prime (') designation.

The cutting sequence beginning at position A1 shows the use of one of the water jet cutters 182' in position to cut the ear section or rib meat 190' from the poultry breast 186'. From position A1, the water jet nozzle 182' moves to position A2 and then to position A3 to perform the cutting operation of removing ear section 190'.

Cutting sequence in FIG. 13B shows the use of the water jet cutler 80 to cut the ear section or rib meat 184' from the opposite side of the poultry breast 186'. From position A3, the bridge structure 70 is moved to position B1. Then movement of the beam 70' and cutters 182' is shown as moving from position B1 to position 132 and then to position B3, and finally to position B4.

Next, from Position B4, the bridge structure 70' is shifted (down relative to the page) and rotated slightly clockwise so that the nozzles 182' are positioned on the opposite sides of the keel strip 196' at the right side of the poultry breast 186,' as shown in position C1. Thereafter, the bridge structure is moved in the left hand direction to position C2, wherein the nozzles 182 straddle the keel strip196' of the poultry breast. Thereafter, the bridge structure is moved to the left to position C3 and then to end position C4. In this manner, the keel strip 196' is severed from the poultry breast by the nozzles 182'.

The path traced by the center 128 of the bridge structure 70' is identified as 199 in FIG. 13C. This path starts at position H1 and ends when the bridge structure 70' is at the end position C4.

Figure 10:
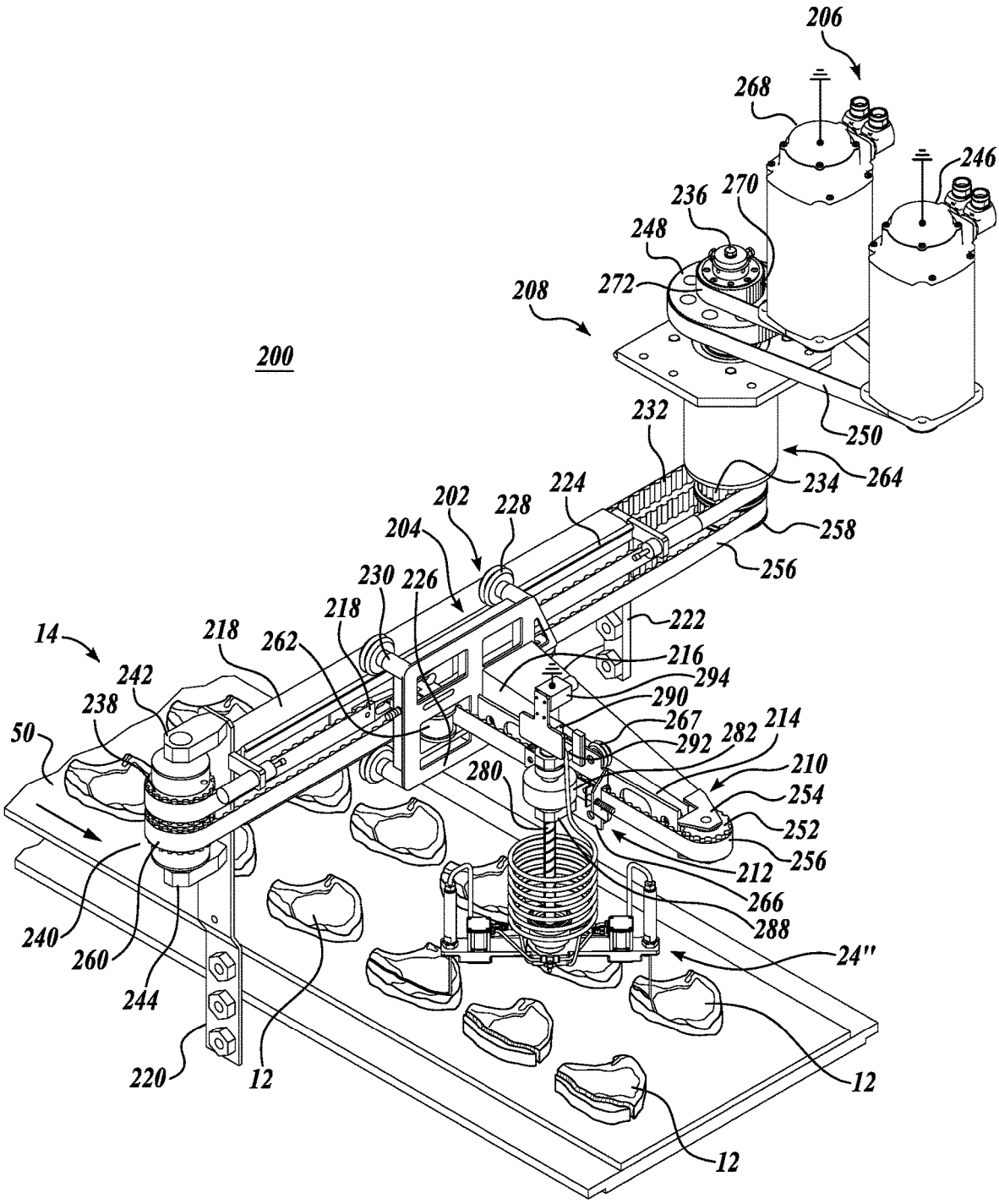
FIG. 10 is an isometric view of a further embodiment of the present disclosure.
Figure 11A:
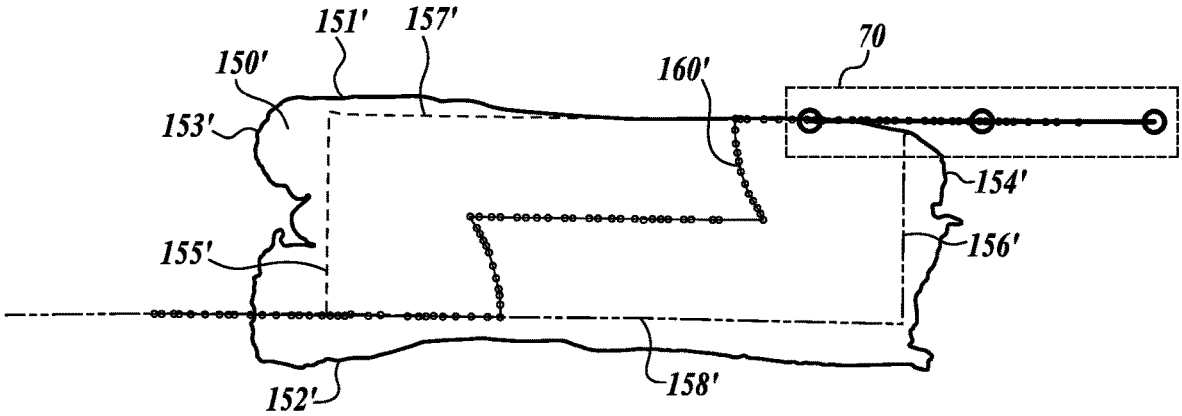
FIGS. 11A-11F show views similar to FIG. 5 illustrating the cutting of a pork belly into a rectangular shape.
Figure 11B:
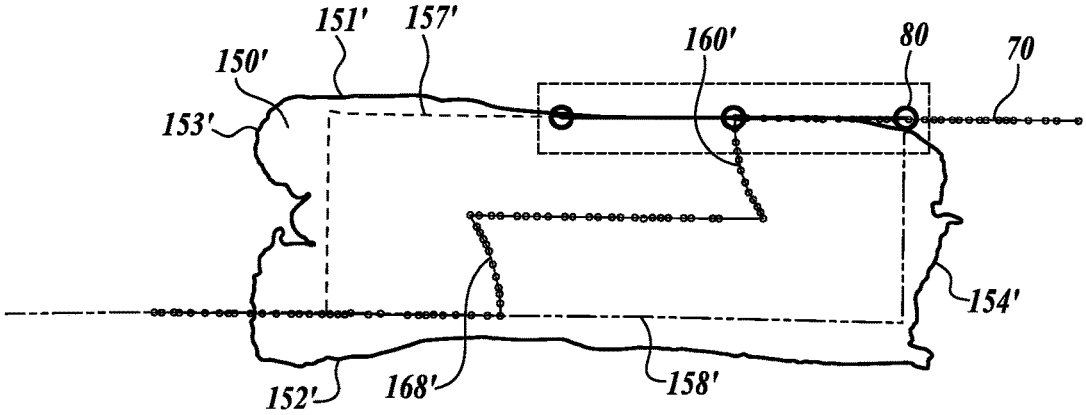
Figure 11C:
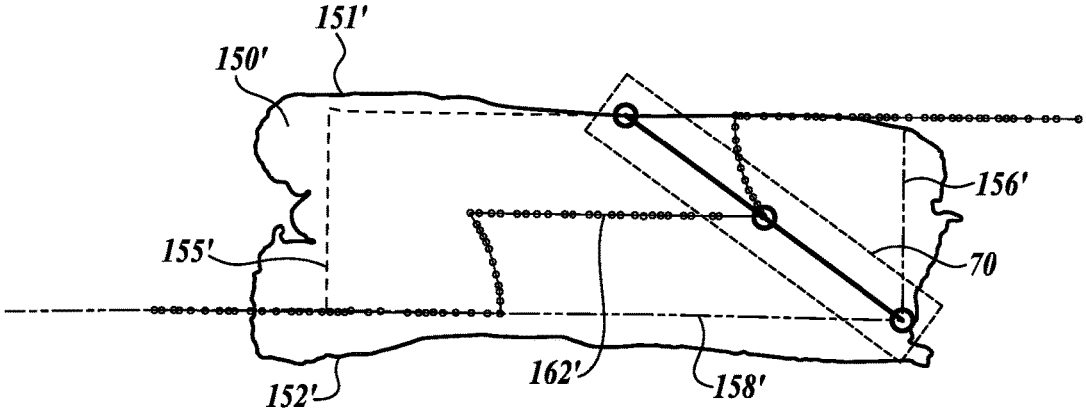
Figure 11D:
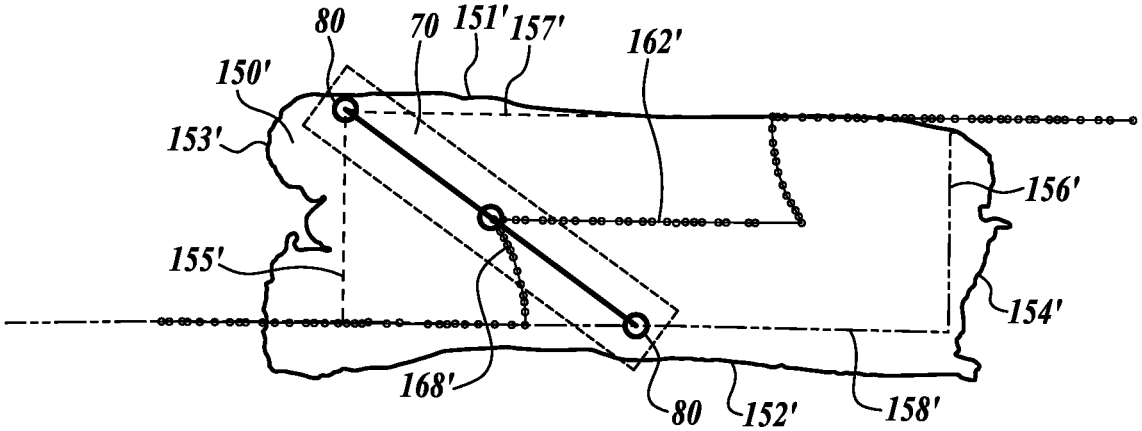
Figure 11E:
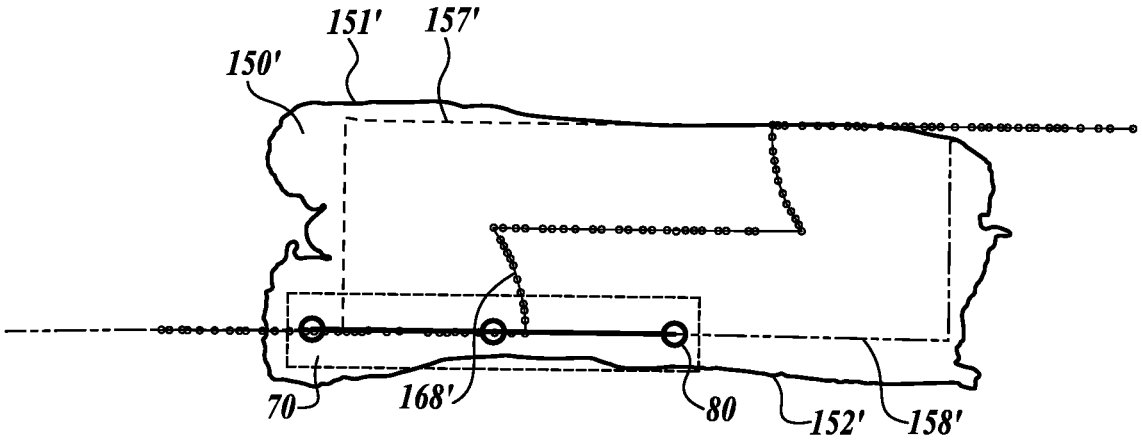
Figure 11F:
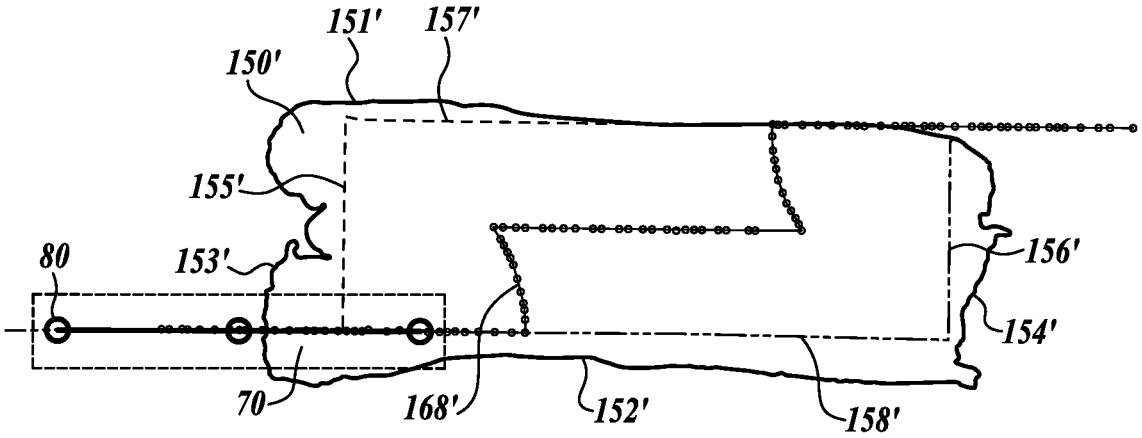

FIG. 10 depicts a further embodiment of the present disclosure in the form of a cutter apparatus/assembly 200 that includes a support structure 202 extending across the conveyor system 14 for supporting and guiding a carriage 204 for movement transversely to the direction of movement of the conveyor belt 50. The carriage 204 is powered by a drive system including, in part, a motive system 206 and a drive train 208. A second, longitudinal support structure or beam 210 is cantilevered outwardly from carriage 204 in a direction generally aligned with the direction of movement of the conveyor system 14. A longitudinal carriage 212 is adapted to travel along the length of the beam structure 210 on a truck 214 extending along a sidewall 216 of the beam.

The transverse support structure 202 is composed of a gantry 218 that spans transversely across the conveyor 14 at an elevation spaced above belt 50. Ideally, the gantry 218 is composed of a hollow, rectangular construction, but may be formed in other manners and shapes without departing from the spirit or scope of the present invention. The ends of gantry 218 are supported by elongated upright brackets 220 and 222. As shown in FIG. 10, bracket 220 is fixed to the adjacent end of the gantry 218 to extend downwardly for mounting to conveyor 14. Bracket 222 extends downwardly from the opposite end of gantry 218 for attachment to the conveyor 14.

Support structure 202 also includes a track for guiding carriage 204 along gantry 218, composed of an upper rail 224 and the lower rail (not visible) attached to the side of the gantry 218 facing the carriage.

Carriage 204 includes a substantially planar, generally rectangularly shaped bed portion 226 having a reinforced outer perimeter for enhanced structure integrity. Openings are formed in bed 226 to reduce its weight while retaining the structural integrity of the bed. Carriage rollers 228 are attached to the corners of the bed 226 by stub axles 230 to roll on top of the upper rail 224 and roll against the bottom edge of the lower rail.

Carriage 204 is powered to move back and forth along gantry 218 by motive system 206. In this regard, a timing belt 232 extends around a driven pulley 234 located at the lower end of drive shaft assembly 236 of motive system 206 and also around an idler pulley 238 of an idler assembly 240 mounted on the upper end of bracket 220 by upper and lower bracket ears 242 and 244 that project from the bracket. As such, the belt 232 makes a loop around the gantry 218, extending closely along the sides of the gantry. The ends of belt 232 are connected to the backside of carriage bed 226.

The motive system 206 includes a servo motor 246 programmable to control the movement of the carriage 224 back and forth along gantry 218 as desired. A hollow drive shaft (not shown) extends up through drive shaft assembly 236. The driven pulley 234 is attached to the lower end of the hollow drive shaft, and a drive pulley 248 is attached to the upper end of the hollow drive shaft. The drive pulley 248 is connected by belt 250 to an output drive pulley (not visible) powered by motor 246. It will be appreciated that by the foregoing construction, the servo motor 246 is located remotely from the carriage 204, with the driving force applied to the carriage by the lightweight timing belt 232.

The longitudinal support structure or beam 210 cantilevers transversely from carriage 204 to be carried by the carriage. The beam 210 includes a vertical sidewall 216, which is substantially perpendicular to the adjacent face of carriage bed 226. The opposite sidewall of the beam 210, rather than being substantially perpendicular to the carriage bed 226, tapers towards sidewall 216 in the direction away from the carriage bed 226. Likewise, the top and bottom walls of beam 210 slope down and up, respectively, towards the free end of the beam, thereby to cooperatively form a generally tapered shape. As will be appreciated, this enhances the structural integrity of the beam while reducing its weight relative to a parallel-piped structure.

An idler pulley 252 is mounted on the free end of beam 210 by a formed bracket 254 which is fixedly attached to the beam. A timing belt 256 is powered to rotate the pulley 252. The timing belt 256 is trained around a driven pulley 258 of motive system 206. A servo motor 268 which is drivingly connected with drive pulley 258 by a drive shaft 236 that extends downwardly through a drive shaft assembly. A drive pulley 270 is attached to the upper end of drive shaft 236, which pulley is connected via timing belt 272 to a drive pulley (not visible) powered by motor 268. The drive shaft 236 is disposed within the hollow drive shaft extending between pulleys 234 and 248.

The portion of drive train 208 connecting the timing belt 256 to motive system 206 is trained around an idler pulley 260 located below idler pulley 238 on the idler assembly 240 which is secured to the end of gantry 218 opposite the motive system 206. As such, the belt 256 also extends along the opposite sidewalk of gantry 218, but at an elevation spaced below belt 232.

The belt 256 also trains around idler pulleys 262 mounted on transverse carriage 204. The idler pulleys 262 redirect the belt 256 to extend along the sides of longitudinal beam 210.

A work tool in the form of the dual headed cutter assembly 24" is mounted on the carriage 212 to move longitudinally of the conveyor 14 as the cutter assembly 24 is operating on the underlying work product(s) 12 being carried by the conveyor 14.

The elongated track 214 is mounted on and extends longitudinally along beam sidewall 216. Track 214 includes formed upper and lower edge portions that are spaced away from sidewall 216 to define upper and lower rails for guiding the longitudinal carriage 212. The track 214 is attached to beam sidewall 216 by a plurality of hardware members.

The longitudinal carriage 212 is adapted to travel along track 214. In this regard, the carriage 212 includes a substantially planar, rectangular-shaped bed portion 266 and a pair of upper rollers 267 and a pair of comparable lower rollers (not shown) having concave outer perimeter portions sized to closely engage with the corresponding crowned track 214, having an upper and lower rail edge portions. The upper and lower rollers are mounted on stub shafts extending transversely from the carriage bed 226.

Carriage 212 is moved back and forth along track 214 by the second motive system 264, constructed similarly to motive system 206, to power the timing belt 256. The drive train for the timing belt 256 has been described above.

As shown in FIG. 10, the cutter assembly 200 includes a shaft 280 that depends downwardly from a rotary actuator 282 mounted on the carriage 212. The shaft is connected to and supports cutter assembly 24". The underside of the rotary actuator 282 may be connected to a carriage bed 266 by a lower mounting bracket 288.

A hollow stem 290 projects upwardly from the upper side of the rotary actuator 282 through which an electrical feed and cooling air is routed to the connector 76. An upper bracket 292 secures the stem to the carriage bed 266. An entrance elbow 294 may be attached to the upper end of the stem 290.

It will be appreciated that apparatus 200 is capable of moving the dual headed cutter assembly 24" longitudinally of the travel direction of the conveyor belt 50, across the width of the conveyor belt 50 as well as rotating the bridge structure 70 about a vertical axis corresponding to shaft 280. Although the system 200 may not have the acceleration capability of the robot actuator 22, the apparatus 20 nonetheless is capable of moving and operating the cutter assembly 24" to accomplish many of the same functions as performed by cutter assembly 24 described above, as well as cutter assembly 24' described above and as illustrated in FIGS. 6-9.

While illustrative embodiments have been illustrated and described, it will be appreciated that various changes can be made therein without departing from the spirit and scope of the invention. For example, although the waterjet cutters 80 and nozzles 82 are depicted as directing water jets in a substantially vertically downward direction, the waterjet's trajectory is at an angle to the vertical so as to make beveled or sloped cuts along the workpiece. Such cuts are not uncommonly made along the side edges or ends of a pork belly or other food item.

In addition, the shaft 280 shown in FIG. 10 can be adapted to raise and lower relative to the rotary actuator 282. This will enable the bridge structure 70" to be raised and lowered, for example, to accommodate the thickness of the work pieces being trimmed or otherwise cut.

Further, it is to be understood that the systems of the present disclosure can be utilized to trim, or otherwise cut, different types of work products, including food items at the same time. In this regard, one type of work product, for example, one type of food item, can be arranged in a first row along the length of the conveyor system 14, and a second type of work product, including a second food item, can be arranged in a second side by side row along the length of the conveyor system. The control system 30 is capable of controlling the pressure of the water jets emitted by the cutting apparatus 20 to accommodate the physical characteristics of the work products being trimmed or otherwise cut.

In addition, although the bridge structure 70 is illustrated as being in the form of a longitudinal structure, the bridge structure can be in other shapes or configurations, for example, arcuate in shape, or even circular in shape or elliptical in shape.

Further, the dual headed cutter assembly 24' can be operated so that the nozzles 182 follow the same cutting path. This enables a work product to be cut using a lower pressure waterjet than if the cut were required to be made by a single nozzle. As a consequence, a smaller size pump can be utilized, and the lower pressure of the waterjets can result in a lower wear of the conveyor belt on which the work product is carries as well as less noise generated by the waterjets. Also, the use of two nozzles 182 traveling the same cut path enables the cutter assembly 24' to cut through tougher work products than possible with a single nozzle.

As another example, the nozzles 182 can be of various lateral distances apart from each other. In this regard, the lateral positions of the nozzles 182 can be adjustable on the bridge 70'. Further, the nozzles do not need to be exactly lateral to each other, but instead may be staggered relative to the length of the bridge 70 so as to achieve a desired distance separating the nozzles 182 relative to the orientation of the bridge relative to the direction of travel of the cutting apparatus.

In addition, various types of actuators have been illustrated and describe above, such as robot actuator (SCARA) 22 and X-Y (cartesian) actuator 200. However, other types of actuators can be used with system 10, including, for example, delta robots, cylindrical robots, and 6-axis robots.

The invention claimed is:

1. An apparatus for independently cutting the opposite sides of a workpiece or two separate workpieces as the workpiece(s) is(are) being conveyed on a conveyance device, the conveyance device defining a transport plane for supporting the workpiece being conveyed by the conveyance device, the apparatus comprising:

(a) a cutter assembly comprising:

beam cutters mounted at spaced apart locations on the cutter assembly to direct culling beams toward the transport plane;

(b) an actuator for supporting and moving the cutter assembly above the support plane; and (c) a control system for controlling the operation of the conveyor assembly, the actuator, and the beam cutters to move the beam cutters relative to the workpiece and to operate the beam cutters to independently cut a singular workpiece along spaced apart culling paths relative to the workpiece or independently cut separate workpieces along spaced apart cutting paths, while the workpiece(s) is(are) being transported on the conveyance device.

2. The apparatus of claim 1, wherein the cutting paths are not tied to each other.

3. The apparatus according to claim 2, wherein the control system controlling the operation of the actuator in one or more of the following manners:

to position one of the beam cutters ahead of another beam cutter relative to the upstream direction of the conveyor;

to hold one of the cutters stationary while another cutter is operational to cut the workpiece;

to cause one of the cutters to reverse its direction of travel relative to the cutting direction of the cutter while another cutter is operational to cut the workpiece.

4. The apparatus of claim 1, wherein the cutler assembly further comprises:

an activator for switching the cutter beam between an activated condition and a deactivated condition, and wherein the control system controls the operation of the activator.

5. The apparatus according to claim 1, wherein the control system controlling the operation of the actuator in one or more of the following manners:

to position one of the beam cutters ahead of another beam cutter relative to the upstream direction of the conveyor;

to hold one of the cutters stationary while another cutter is operational to cut the workpiece;

to cause one of the cutters to reverse its direction of travel relative to the cutting direction of the cutter while another cutter is operational to cut the workpiece.

6. The apparatus according to claim 1, wherein the actuator comprises a first arm having a proximal end pivotable about an axis relative to a base and a distal end extending from the base, a second arm having a first end pivotable about the distal end of the first arm and a second end, and a mounting attachment disposed at the second end of the second arm for rotation about an upright axis.

7. The apparatus according to claim 6, wherein the mounting attachment is movable in the upright direction toward and away from the transport plane.

8. The apparatus according to claim 6, wherein the mounting attachment is rotatable about at least one axis extending substantially parallel to the horizontal.

9. The apparatus according to claim 1, further comprising a scanner for scanning the workpieces being transported on the conveyor and for generating data with respect to the physical parameters of the scanned workpieces.

10. The apparatus according to claim 9, wherein the control system utilizes the data generated by the scanner to determine cutting paths along the workpieces for the beam cutters.

11. The apparatus according to claim 1, wherein the cutter assembly comprises a mounting structure on which the cutter beams are mounted.

12. The apparatus according to claim 11, wherein the actuator supporting and moving the mounting structure above the transport plane along the length of the conveyance device, across the conveyance device, and rotatably about an upright axis relative to the transport plane.

13. The apparatus according to claim 11, wherein the actuator supporting the mounting structure for movement toward and away from the transport plane.

14. The apparatus according to claim 11, wherein a plurality of beam cutters are located at at least one of the space-apart locations on the mounting structure.

15. The apparatus according to claim 14, wherein the control system controlling the beam cutters so that at least two beam cutters follow the same path.

16. A cutter assembly for cutting workpieces being conveyed on a conveyance device, the cutter assembly adapted to be supported above the conveyance device by an actuator for moving the cutter assembly relative to the conveyance device, the cutter assembly comprising:

beam cutters mourned at spaced apart locations on the cutter assembly to direct cutting beams toward the conveyance device;

an activator carried by the cutter assembly for switching at least one of the beam cutters between an activated condition and a deactivated condition.

17. The cutler assembly according to claim 16, wherein multiple beam cutters are mounted at at least one of the spaced apart locations on the cutter assembly.

18. The cutter assembly according to claim 17, further comprising an elongate mounting bridge with the beam cutters mounted at spaced apart locations along the mounting bridge.

19. The cutter assembly according to claim 18, wherein the multiple beam cutters are positioned relative to each other laterally of the length of the mounting bridge.

20. The cutter assembly according to claim 16, further comprising a control system for controlling the operation of the conveyance device, the activator, and the beam cutters to determine cutting paths for the beam cutters along the workpieces and to move the beam cutters relative to the workpiece and to operate the beam cutters to independently cut a singular workpiece along two spaced apart cutting paths, or independently cut two separate workpieces along spaced apart cutting paths, while the workpiece(s) is(are) being transported on the conveyance device.

21. The cutter assembly according to claim 20, wherein the spaced apart cutting paths are not tied to each other.

22. The cutter assembly according to claim 21, wherein the control system controls the operation of the activator in one or more of the following ways:

to position one of the beam cutters ahead of another beam cutter relative to the upstream direction of the conveyance device;

to hold one of the cutters stationary while another beam cutter is operational to cut the workpiece;

to cause one of the beam cutters to reverse its direction of travel relative to the cutting direction of the beam cutter while another beam cutter is operational to cut the workpiece; and to cause at least two beam cutters to follow the same cutting path.

23. The cutter assembly according to claim 20, wherein the control system controls the operation of the activator in one or more of the following ways:

to position one of the beam cutters ahead of another beam cutter relative to the upstream direction of the conveyance device;

to hold one of the cutters stationary while another beam cutter is operational to cut the workpiece;

to cause one of the beam cutters to reverse its direction of travel relative to the cutting direction of the beam cutter while another beam cutter is operational to cut the workpiece; and to cause at least two beam cutters to follow the same cutting path.

* * * * *